US012491607B2

(12) United States Patent
Song et al.

(10) Patent No.: US 12,491,607 B2
(45) Date of Patent: Dec. 9, 2025

(54) ELECTROPLATED STEEL WIRE SEGMENT-COMBINED GRINDING WHEEL

(71) Applicants: Jingxin Song, Guilin (CN); GUILIN CHAMPION UNION DIAMOND CO., LTD., Guilin (CN)

(72) Inventors: Jingxin Song, Guilin (CN); Huiling Long, Guilin (CN); Anning Liang, Guilin (CN); Liang Zhao, Guilin (CN); Zhiyong Wang, Guilin (CN)

(73) Assignees: Jingxin Song, Guilin (CN); GUILIN CHAMPION UNION DIAMOND CO., LTD., Guilin (CN)

( * ) Notice: Subject to any disclaimer, the term of this patent is extended or adjusted under 35 U.S.C. 154(b) by 657 days.

(21) Appl. No.: 17/792,150

(22) PCT Filed: Dec. 28, 2020

(86) PCT No.: PCT/CN2020/140143

§ 371 (c)(1),
(2) Date: Jul. 12, 2022

(87) PCT Pub. No.: WO2021/143504

PCT Pub. Date: Jul. 22, 2021

(65) Prior Publication Data

US 2023/0052287 A1 Feb. 16, 2023

(30) Foreign Application Priority Data

Jan. 13, 2020 (CN) ..... 202010031550.5
Jan. 13, 2020 (CN) ..... 202010032109.9
(Continued)

(51) Int. Cl.
*B24D 5/10* (2006.01)

(52) U.S. Cl.
CPC ..... *B24D 5/10* (2013.01)

(58) Field of Classification Search
CPC ... B24D 5/02; B24D 5/04; B24D 5/06; B24D 5/066; B24D 5/08; B24D 5/123;
(Continued)

(56) References Cited

U.S. PATENT DOCUMENTS 3,427,759 A * 2/1969 Rue ..... B24D 5/04 451/546
6,110,031 A * 8/2000 Preston ..... B24D 5/14 451/529
(Continued)

FOREIGN PATENT DOCUMENTS

CN 2241609 Y 12/1996
CN 201669627 U 12/2010
(Continued)

*Primary Examiner* — David S Posigian
*Assistant Examiner* — Tyler James Mcfarland
(74) *Attorney, Agent, or Firm* — Bayramoglu Law Offices LLC

(57) ABSTRACT

An electroplated steel wire segment-combined grinding wheel includes a base component for connecting an external device, and steel wire segments, wherein the steel wire segments are combined and assembled on the base component in a ring, and outer walls of the steel wire segments are plated with diamonds to form a grinding surface. The steel wire segments are combined and assembled mechanically on a support base, wherein the support base is a reusable tool, and replacing the grinding surface combined by the steel wire segments is convenient for reducing a renovation cost of the electroplated steel wire segment-combined grinding wheel. For the electroplated steel wire segment-combined grinding wheel, drainage channels are naturally formed between the steel wire segments and segment arcs, and thus, internally cooled type cooling and rapid chip removal are facilitated.

18 Claims, 20 Drawing Sheets

(30) Foreign Application Priority Data

Jan. 13, 2020 (CN) ..... 202020061554.3
Jan. 13, 2020 (CN) ..... 202020062307.5

(58) Field of Classification Search
CPC ... B24D 7/02; B24D 7/04; B24D 7/06; B24D 7/066; B24D 7/08; B24D 7/10; B24D 7/18; B24D 13/02; B24D 13/14; B24D 13/142; B24D 13/145; B24D 13/18; B24D 2203/00; B24D 13/10; Y02P 70/10; B24B 29/005
USPC ..... 451/449, 450, 541, 542, 543, 546, 548, 451/551
See application file for complete search history.

(56) References Cited

U.S. PATENT DOCUMENTS

2002/0197941 A1* 12/2002 Bruno ..... B24D 13/145 451/360
2010/0317267 A1* 12/2010 Soma ..... B24D 7/18 51/297
2015/0283670 A1* 10/2015 Tsuno ..... B08B 3/02 134/23
2017/0304997 A1* 10/2017 Akashi ..... B24D 9/003

FOREIGN PATENT DOCUMENTS

CN 106903567 A * 6/2017 ..... B24B 41/002
CN 111113285 A 5/2020
CN 111113286 A 5/2020
CN 211517190 U 9/2020
CN 211639546 U 10/2020
DE 4109647 A1 9/1992
KR 20090012476 A 2/2009

* cited by examiner

ELECTROPLATED STEEL WIRE SEGMENT-COMBINED GRINDING WHEEL

CROSS REFERENCE TO THE RELATED APPLICATIONS

This application is the national stage entry of International Application No. PCT/CN2020/140143, filed on Dec. 28, 2020, which is based upon and claims priority to Chinese Patent Application No. 202010031550.5 filed on Jan. 13, 2020; Chinese Patent Application No. 202020061554.3 filed on Jan. 13, 2020; Chinese Patent Application No. 202010032109.9 filed on Jan. 13, 2020; and Chinese Patent Application No. 202020062307.5 filed on Jan. 13, 2020, the entire contents of which are incorporated herein by reference.

TECHNICAL FIELD

The present invention relates to the field of grinding wheel tool technologies, and in particular, to an electroplated steel wire segment-combined grinding wheel.

BACKGROUND

Usually, only a few water passing grooves are machined in the base of an existing electroplated grinding wheel, because the processing cost increases along with the increased number of the water passing grooves. For a grinding wheel electroplated with diamonds, a few strip-shaped regions in the grinding wheel are not electroplated with the diamonds to form water passing grooves. However, these water passing grooves have small space, producing limited effect. The cooling effect of both the above externally cooled grinding wheels, is affected by the diamond particle size: the smaller the diamond particle size is, the smaller a water-passing and chip-accommodating space is, and the worse the cooling effect is.

At present, a combined grinding wheel is formed by combining a plurality of thin single-segmented sheets. In a single-segment machining process, a powder metallurgy process is used: the single segment is molded from an abrasive embedded in a metal bonding agent by hot-pressing and sintering with a mold. In such structural design, water channels are formed among the single-segmented sheets of the grinding wheel, and are densely distributed. The single-segmented sheets are combined to form the grinding wheel, so that the grinding wheel has the effects of rapid chip removal and rapid cooling. The cooling effect is greatly improved as internal cooling is realized. However, there is no similar structural design for the electroplated grinding wheel at present; and it is difficult for a cooling and chip removal method adopted by an existing electroplated grinding wheel to achieve the effect achieved by the grinding wheel formed by combining thin single-segmented sheets. In addition, if water grooves are densely machined in the base, the cost is extremely high, causing poor cost performance. If dense strip-shaped regions are shielded from being plated with the diamonds, a manufacturing process is cumbersome and difficult.

SUMMARY

A technical problem to be solved by the present invention is to provide an electroplated steel wire segment-combined grinding wheel for defects in the prior art.

The present invention adopts the following technical solution to solve the above technical problem. An electroplated steel wire segment-combined grinding wheel includes a base component for connecting an external device, and a plurality of steel wire segments, wherein the steel wire segments are combined and assembled on the base component in a ring, and outer walls of the steel wire segments are plated with diamonds to form a grinding surface.

The present invention has the benefits as follows. The steel wire segments are combined and assembled mechanically on a support base, the base is a reusable tool and can be reused, and it is convenient to replace the grinding surface combined by the steel wire segments, so that the renovation cost of the grinding wheel is greatly reduced. For the steel wire segment-combined grinding wheel, spaces between the segments and segment arcs and spaces formed by exposed diamond particles naturally form drainage channels between the segments and the segment arcs, and thus internally cooled type cooling and rapid chip removal are facilitated.

Based on the above technical solution, the present invention can also be improved as follows.

Further, the electroplated steel wire segment-combined grinding wheel further includes a first support ring for supporting the steel wire segments, and a fixing part for fixing the first support ring, wherein the base component includes a first base; the fixing part is disposed opposite to the first base, and the first support ring is held between the fixing part and the first base; and the steel wire segments are arranged on the outer wall of the first support ring.

Further, the first base is of a circular disc structure, the fixing part includes a first pressure plate of an annular disc structure, and the first support ring has an annular groove structure; the first pressure plate is disposed coaxially opposite to the first base;

a groove bottom of the first support ring is disposed outward and parallel to the central axis of the first base, a groove opening of the first support ring is disposed inward, one end of the groove opening of the first support ring is abutted against the outer edge of the first base, and the other end of the groove opening of the first support ring is abutted against the outer edge of the first pressure plate; a cavity is formed among the first base, the first support ring and the first pressure plate; and the steel wire segment is bent to have a U shape and bonded to the outer wall of the groove bottom of the first support ring, one end of the steel wire segment is clamped into a slit between the first base and one end of the groove opening of the first support ring, the other end of the steel wire segment is clamped into a slit between the first pressure plate and the other end of the groove opening of the first support ring, and the plurality of steel wire segments is arranged circumferentially in parallel.

With the adoption of the above further solution, the following benefit is achieved: the steel wire segments are combined and assembled mechanically on a support base, the base is a reusable tool and can be reused, and it is convenient to replace a working surface combined by the steel wire segments, so that the renovation cost of the grinding wheel is greatly reduced.

Further, the base component includes a second base; the electroplated steel wire segment-combined grinding wheel further includes a second support ring for supporting the plurality of steel wire segments, a third base for fixing the second support ring onto the second base, and a holding part for tightly holding the steel wire segments; the third base is stacked on one side of the second base, and the holding part and the second support ring are disposed on the third base in parallel; and the steel wire segments are arranged on the second support ring and are plated with diamonds to form the grinding surface, and one end of the steel wire segment is clamped into a slit between the holding part and the second support ring.

With the adoption of the above further solution, the following benefits are achieved. The steel wire segments are combined and assembled mechanically on the support ring, the base is a reusable tool and can be reused, and it is convenient to replace the grinding surface combined by the steel wire segments, so that the renovation cost of the grinding wheel is greatly reduced. For the steel wire segment-combined grinding wheel, an axial working surface is formed and a large number of dense water channels are naturally formed between the segments and segment arcs, so that internally cooled type cooling and rapid chip removal are facilitated.

Further, the holding part includes a second pressure plate, the second base is of a circular disc structure, and each of the third base, the second pressure plate and the second support ring takes the shape of a ring-shaped disc; the third base is coaxial with the second base, and stacked on the outer edge of the second base; the second pressure plate and the second support ring are coaxial with the second base and are disposed on the third base in parallel from inside to outside, and the axial length of the second support ring is greater than the axial length of the second pressure plate; and the plurality of the steel wire segments is arranged in a ring, and are bonded onto inner and outer side walls of the second support ring and a side wall, away from the third base, of the second support ring in a bent manner.

With the adoption of the above further solution, the following benefits are achieved. The steel wire segments are combined and assembled mechanically on the support ring to form an annular grinding surface; one ends of the steel wire segments are clamped and stably fixed between the second pressure plate and the holding part to prevent the steel wire segments from becoming loose; and the steel wire segments are mounted in a clamping manner, so that it is convenient to replace the all or part of the grinding working surface, and the base is reusable, thereby prolong the service life of the grinding wheel.

In the accompanying drawings, a list of components represented by respective reference signs is as follows:

1, steel wire segment; 2, first support ring; 3, fixing part; 4, first base; 5, pressure disc; 6, support plate; 7, support block; 8, protruding point; 201, water groove outlet; 301, first pressure plate; 302, second annular step; 303, fixing screw; 304, threaded hole; 305, mounting hole; 306, mounting block; 401, first annular step; 501, pressure disc screw; 601, support frame screw; 602, first clamping groove;

9, second base; 10, second support ring; 11, third base; 12, holding part; 13, holding part screw; 14, support ring screw; 15, base screw; 1001, second clamping groove; 1101, first positioning ring; 1102, second positioning ring; 1201, second pressure plate; and 1202, aluminum wire ring,

DETAILED DESCRIPTION OF THE EMBODIMENTS

The principle and features of the present invention are described below with reference to the accompanying drawings and examples are given only for explaining the present invention and are not intended to limit the scope of the present invention.

Embodiment 1: as shown in FIGS. 1 to 26, an electroplated steel wire segment-combined grinding wheel includes a base component for connecting an external device, and a plurality of steel wire segments 1. The steel wire segments 1 are combined and assembled on the base component in a ring, and the outer walls of the steel wire segments 1 are plated with diamonds to form a grinding surface.

In the above embodiment, the steel wire segments 1 are combined and assembled mechanically on the support base, the base is a reusable tool and can be reused, and it is convenient to replace the grinding surface combined by the steel wire segments 1, so that the renovation cost of the grinding wheel is greatly reduced. For the steel wire segment-combined (peripheral) grinding wheel, drainage channels are naturally formed between the segments and segment arcs, and thus, internally cooled type cooling and rapid chip removal are facilitated.

On the basis of Embodiment 1, Embodiment 2 provides a first grinding wheel according to the present invention. The electroplated steel wire segment-combined grinding wheel further includes a first support ring 2 for supporting the steel wire segments 1, and a fixing part 3 for fixing the first support ring 2. The base component includes a first base 4. The fixing part 3 is disposed opposite to the first base 4, and the first support ring 2 is held between the fixing part 3 and the first base 4. The steel wire segments 1 are arranged on the outer wall of the first support ring 2.

Figure 2:
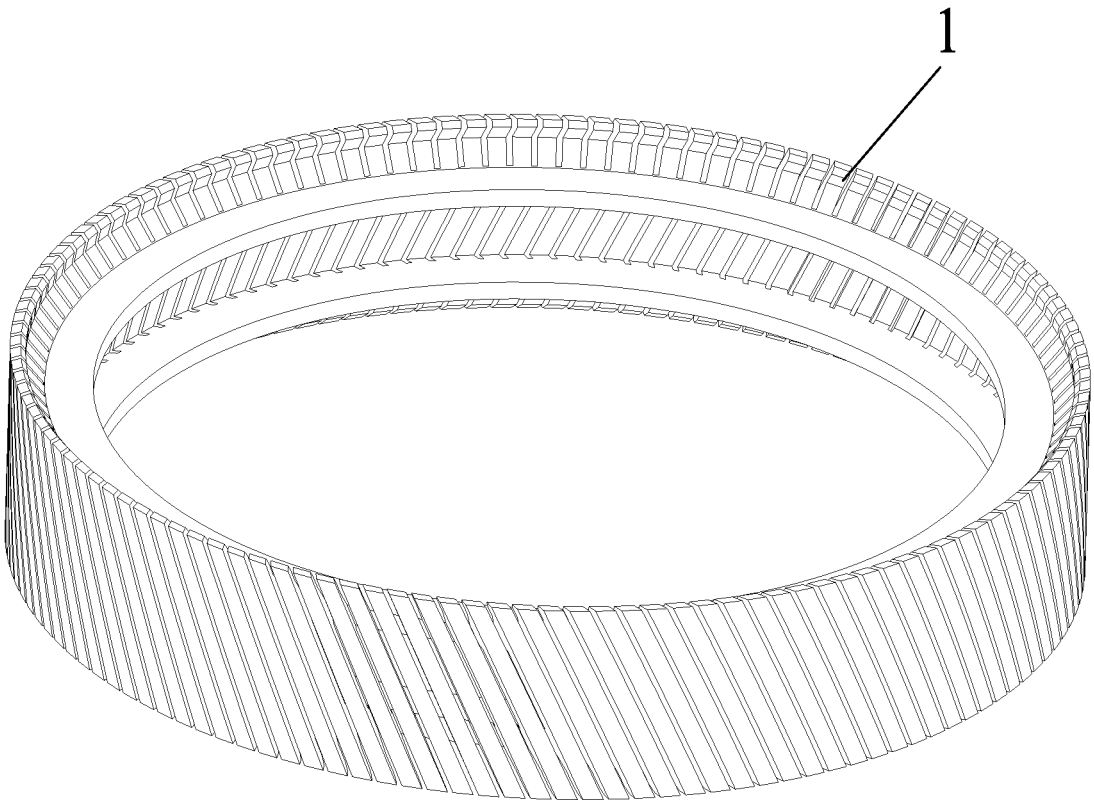
FIG. 2 is a schematic structure diagram of a first support ring according to an embodiment of the present invention.
Figure 3:
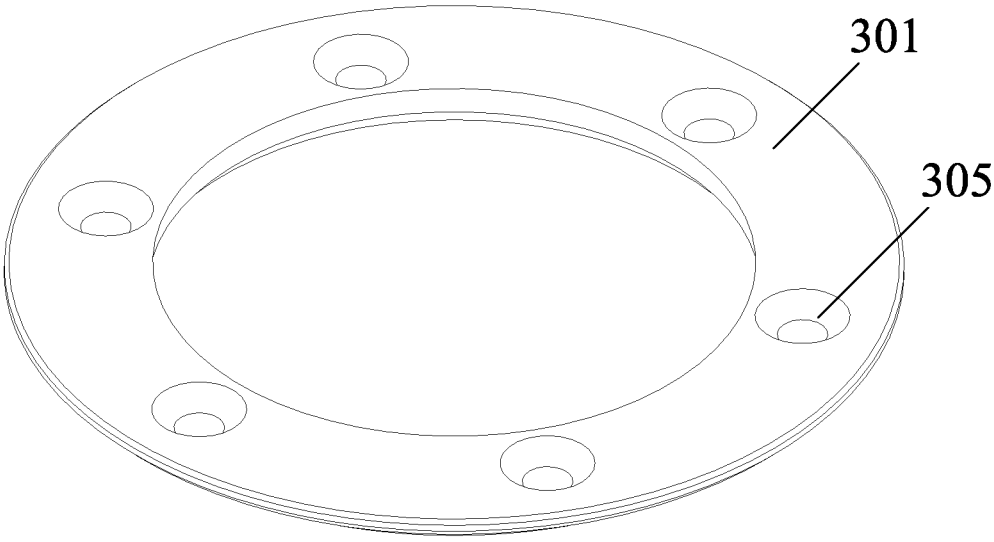
FIG. 3 is a schematic structure diagram of a first pressure plate according to an embodiment of the present invention.
Figure 4:
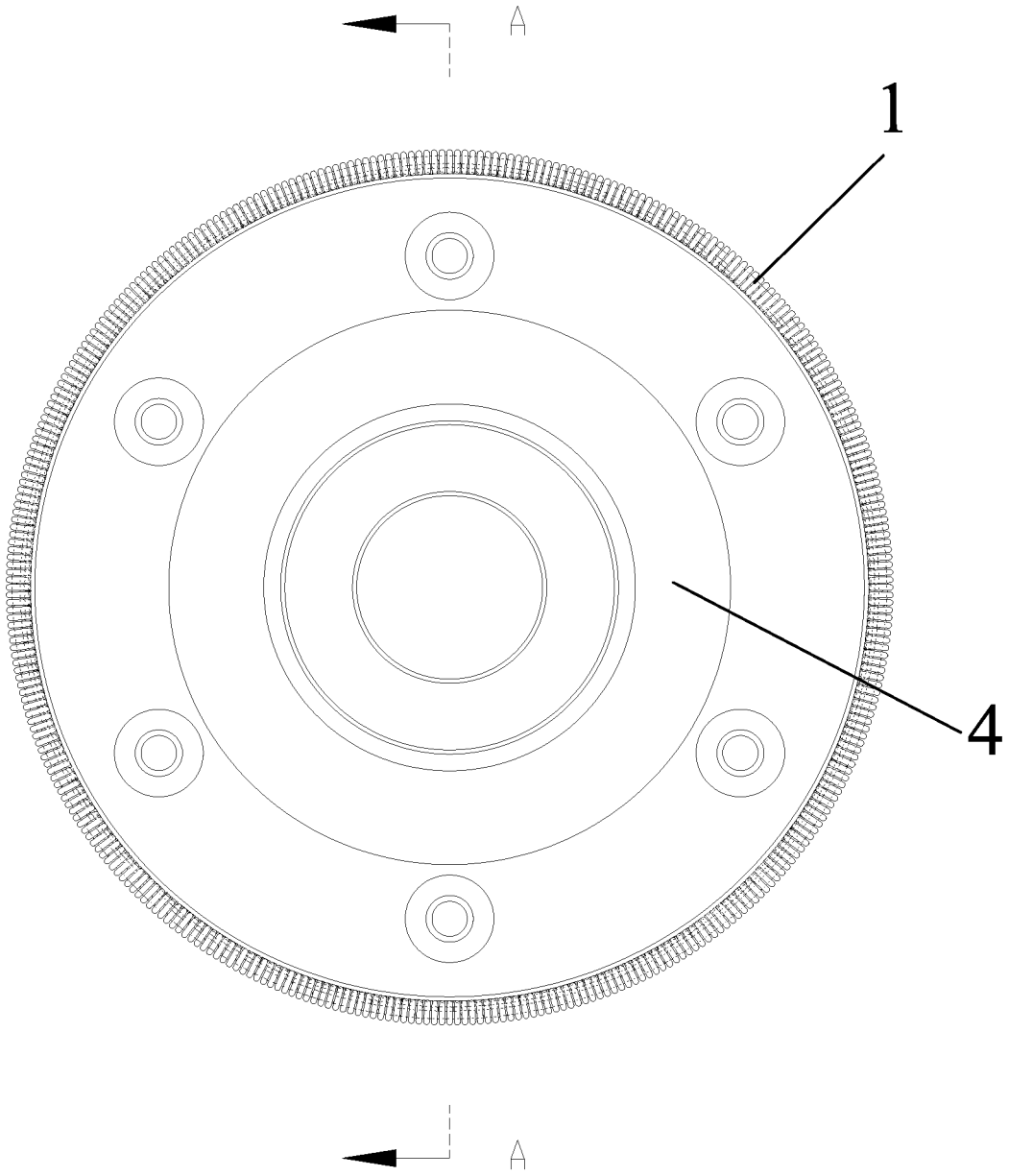
FIG. 4 is a top view of the first electroplated steel wire segment-combined grinding wheel according to the embodiment of the present invention.

On the basis of Embodiment 2, Embodiment 3 is as follows. As shown in FIGS. 2 to 4, the first base 4 is of a circular disc structure. The fixing part 3 includes a first pressure plate 301 of an annular disc structure; the first support ring 2 has an annular groove structure; and the first pressure plate 301 is disposed coaxially opposite to the first base 4.

A groove bottom of the first support ring 2 is disposed outward and parallel to the central axis of the first base 4; a groove opening of the first support ring 2 is disposed inward; and one end of the groove opening of the first support ring 2 is abutted against the outer edge of the first base 4, and the other end of the groove opening of the first support ring 2 is abutted against the outer edge of the first pressure plate 301. A cavity is formed among the first base 4, the first support ring 2 and the first pressure plate 301. The steel wire segment 1 is bent to have a U shape and bonded to the outer wall of the groove bottom of the first support ring 2; one end of the steel wire segment 1 is clamped into a slit between the first base 4 and one end of the groove opening of the first support ring 2; and the other end of the steel wire segment 4 is clamped into a slit between the first pressure plate 301 and the other end of the groove opening of the first support ring 2. The steel wire segments 1 are arranged circumferentially in parallel.

Preferably, the outer diameter of the first pressure plate 301 is equal to the outer diameter of the first base 4.

In the above embodiment, the steel wire segments are combined and assembled mechanically on the first base which supports the steel wire segments, the first base 4 is a reusable tool and can be reused, and it is convenient to replace the grinding surface combined by the steel wire segments, so that the renovation cost of the grinding wheel is greatly reduced.

Figure 5:
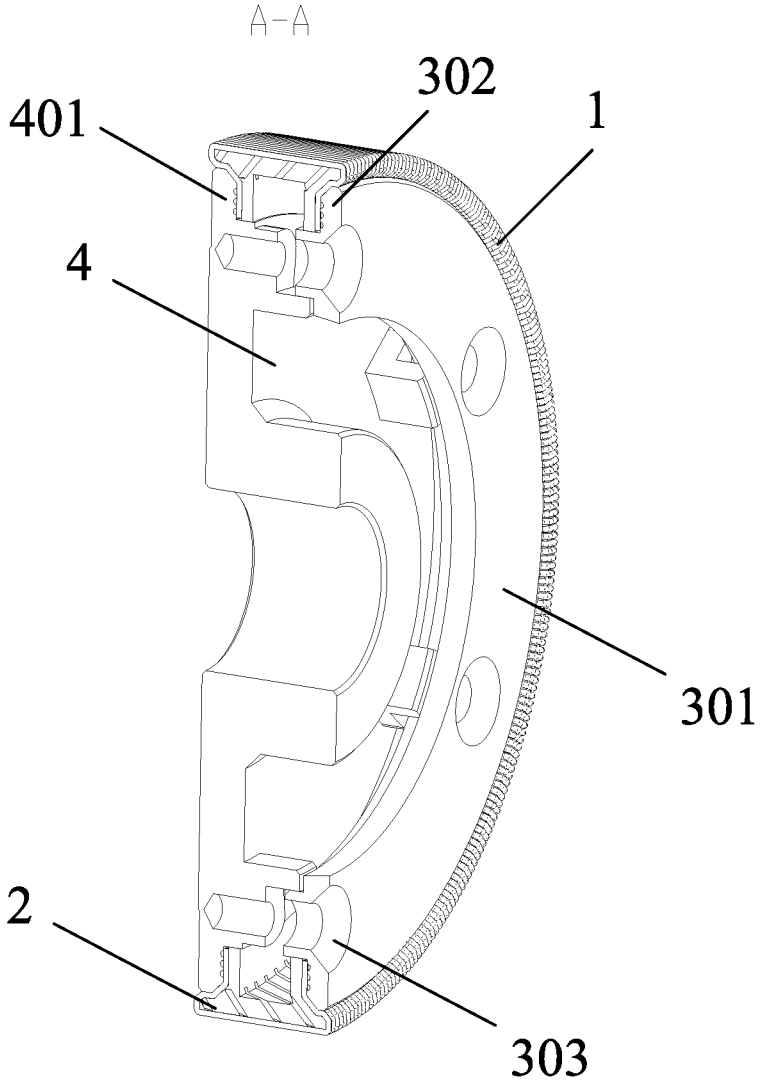
FIG. 5 is a sectional view taken along A-A in FIG. 4 of the present invention.
Figure 6:
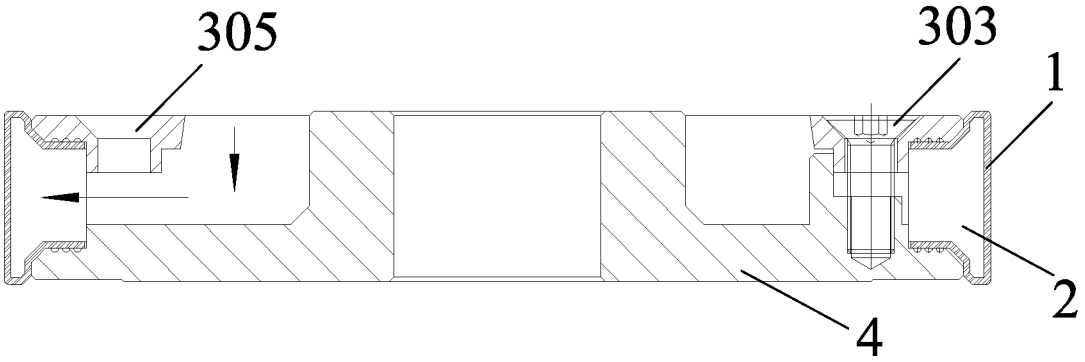
FIG. 6 is a sectional view of the first electroplated steel wire segment-combined grinding wheel according to the embodiment of the present invention.

On the basis of Embodiment 3, Embodiment 4 is as follows. As shown in FIGS. 4 to 6, the first base 4 is recessed axially in a ring in proximity to the end face of the first pressure plate 301 and at the outer edge thereof to form a first annular step 401. The first pressure plate 301 is protruded axially in a ring in proximity to the end face of the first base 4 and in proximity to the inner edge thereof to form an annular protrusion, and a second annular step 302 is formed in proximity to the outer edge of the first pressure plate 301. Two ends of the groove opening of the first support ring 2 are abutted against the first annular step 401 and the second annular step 302 respectively. One end of the outer side of the groove bottom of the first support ring 2 extends out of the outer edge of the first pressure plate 301, and the other end thereof extends out of the outer edge of the first base 4.

In the above embodiment, through the first annular step 401 and the second annular step 302, the first base 4, the first pressure plate 301 and the first support ring 2 can be rapidly positioned, so that the (peripheral) grinding wheel structure is quickly combined. In addition, the two ends of each steel wire segment 1 are quickly clamped between the support ring 4 and the base 1 as well as between the support ring 4 and the pressure plate 301 respectively, so that a working surface combined by the steel wire segments can be replaced conveniently, thereby greatly reducing the renovation cost of the grinding wheel.

Figure 7:
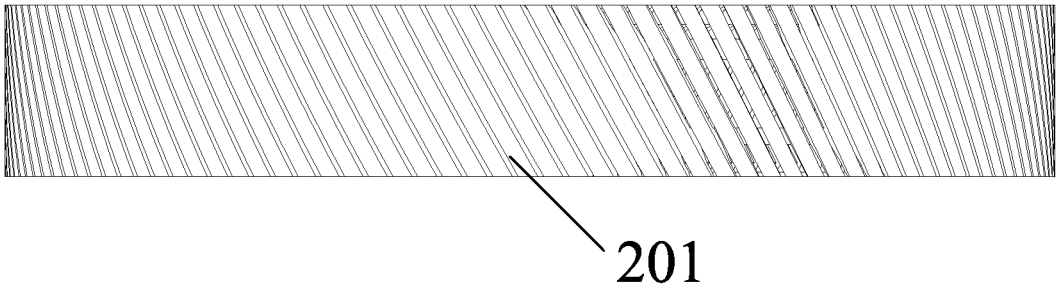
FIG. 7 is a schematic structure diagram of a water groove outlet according to an embodiment of the present invention.

On the basis of Embodiment 4, Embodiment 5 is as follows. As shown in FIG. 7, the first support ring 2 is provided with a plurality of water groove outlets 201 in a ring for leaking cooling water. The water groove outlets 201 extend from the edge of one end of the groove opening of the first support ring 2 to the edge of the other end of the groove opening along the direction towards the groove bottom, and the plurality of water groove outlets 201 is arranged at equal intervals.

The opening of each of the water groove outlets 201 at the edges of two ends of the groove opening of the first support ring 2 extends obliquely along a rotation direction of the first base 4. For the opening of each of the water groove outlets 201 at the groove bottom, by taking the middle as a reference, the end of the opening in proximity the fixing part 3 extends obliquely along the rotation direction of the first base 4, and the other end of the opening in proximity the first base 4 extends obliquely along the direction opposite to the rotation direction.

In the above embodiment, the water groove outlets 201 can form grid-like water channels between the segments and segment arcs of the steel wire segments, which is more conducive to precision grinding with a small cutting depth and ensures that the grinding wheel is supplied with cooling water in a grinding region (a region where a workpiece is in contact with the grinding wheel) at any moment, so that internally cooled type cooling is achieved, and the cooling and chip removal capacities are greatly improved.

Figure 8:
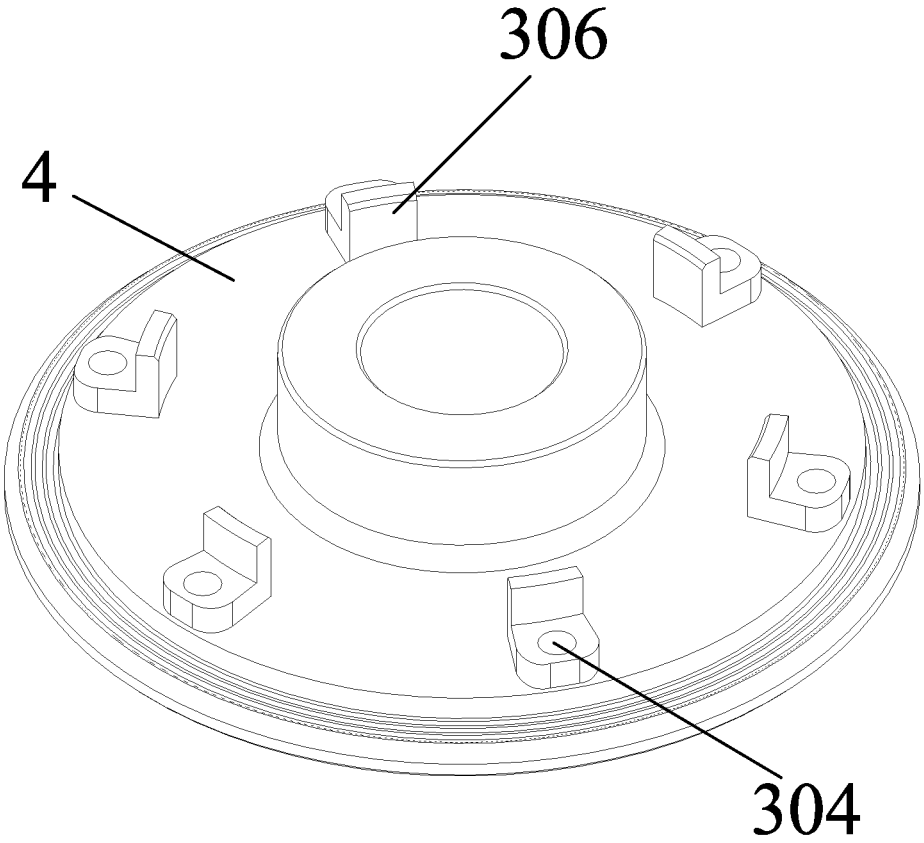
FIG. 8 is a schematic structure diagram of a mounting block according to an embodiment of the present invention.

On the basis of Embodiment 3, Embodiment 6 is as follows. As shown in FIGS. 5, 6 and 8, the fixing part 3 further includes a plurality of mounting blocks 306 and a plurality of fixing screws 303. The plurality of mounting blocks 306 is disposed on the end face, close to the first pressure plate 301, of the first base 4 in a ring at equal intervals. The mounting block 306 is of an L-shaped structure. One end of the mounting block 306 is parallel to the end face of the first base 4, bonded to the first base 4, abutted against the annular protrusion of the first pressure plate 301, and provided with a threaded hole 304. The other end of the mounting block 306 is perpendicular to the first base 4 and abutted against the inner edge of the first pressure plate 301. The first pressure plate 301 is provided with mounting holes 305, the number of which is equal to the number of mounting blocks 306; and the plurality of mounting holes 305 is in one-to-one correspondence with the plurality of mounting blocks 306. The number of fixing screws 303 is the same as that of the mounting blocks 306. The plurality of fixing screws 303 is in one-to-one correspondence with the mounting holes 305, and runs through the annular protrusion from the mounting holes 305 to be connected with the threaded holes 304 of the mounting block 30 respectively.

In the above embodiment, the first support ring 2 can be firmly combined on the first base 4.

Figure 9:
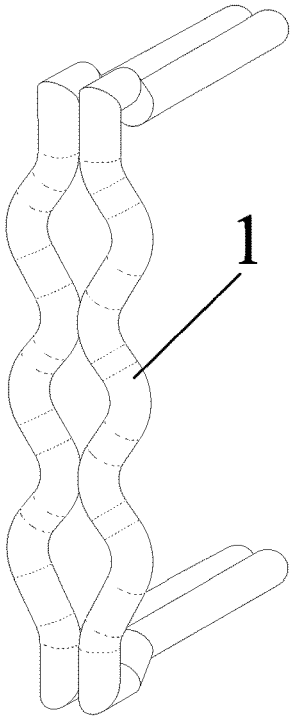
FIG. 9 is a schematic structure diagram of a U-shaped steel wire segment according an embodiment of the present invention.
Figure 10:
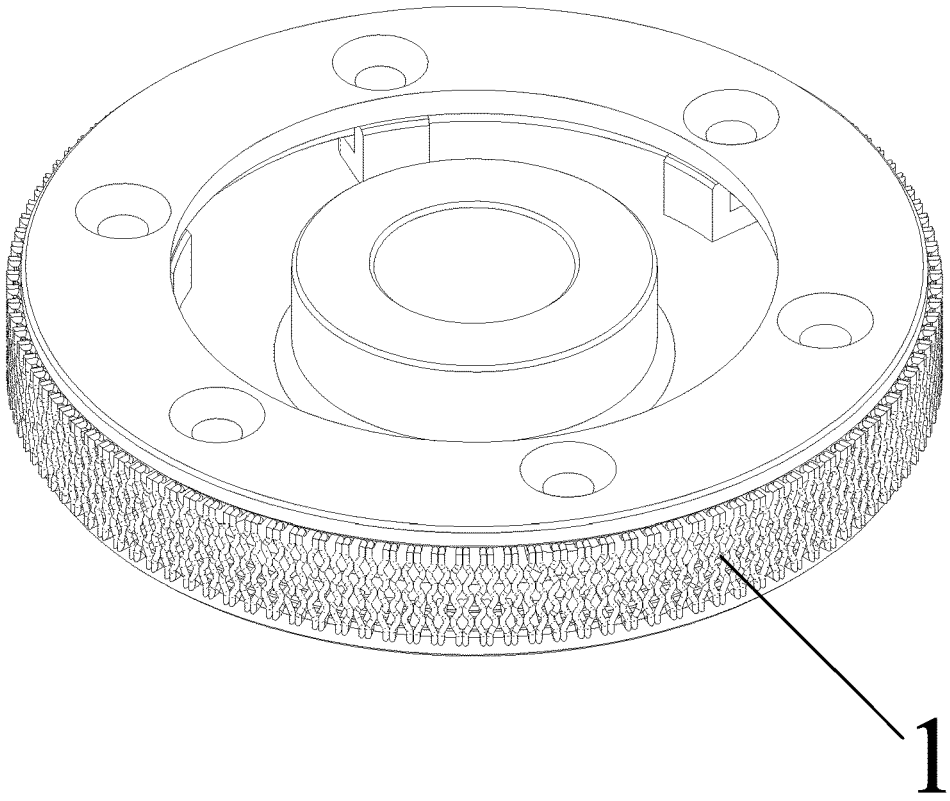
FIG. 10 is a schematic diagram showing mounting of U-shaped steel wire segments according to an embodiment of the present invention.
Figure 12:
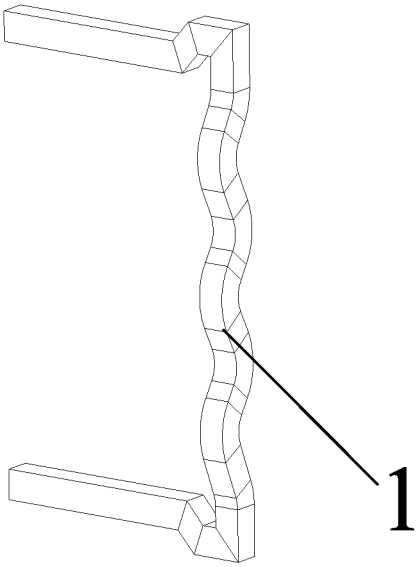
FIG. 12 is a schematic structure diagram of a U-shaped steel wire segment according another embodiment of the present invention.
Figure 13:
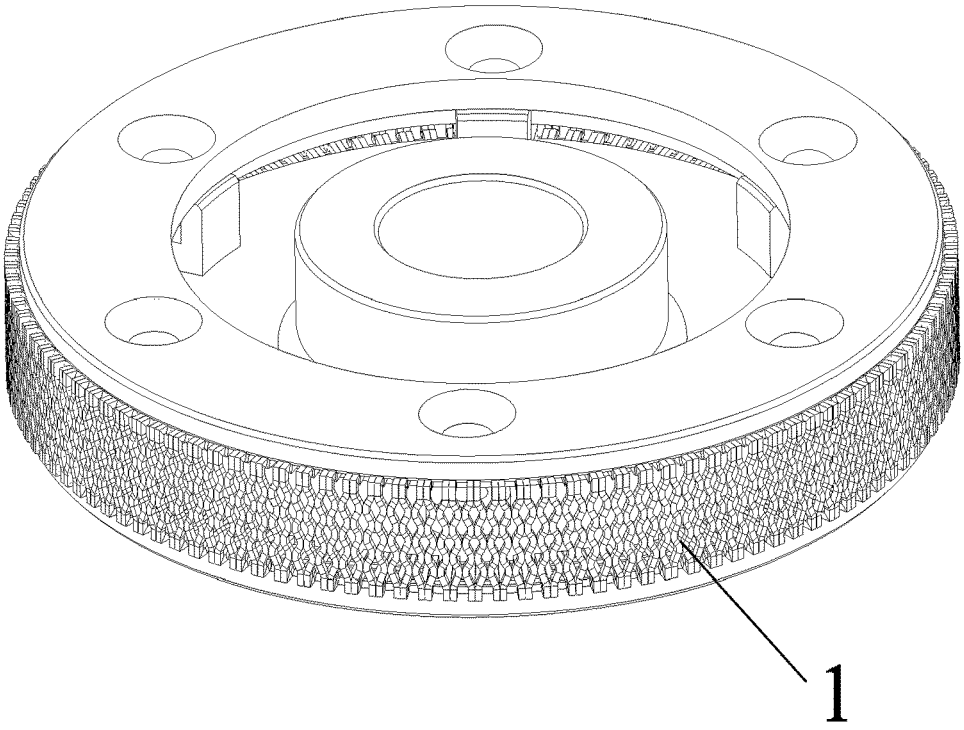
FIG. 13 is a schematic diagram showing mounting of U-shaped steel wire segments according to an embodiment of the present invention.

As shown in FIGS. 9 and 12, the steel wire segment 1 is formed by bending a steel wire with a circular section, or is formed by bending a steel wire with a rectangular cross section or the steel wire segment 1 with a rectangular cross section is stamped from a steel plate. That is, the steel wire segment 1 is a sheet-shaped rectangular steel wire segment.

Specifically, the steel wire segment 1 may be stamped from a thin steel plate having a thickness of 0.1-2 mm.

In the above embodiment, arcuate grooves are naturally formed between the segments and segment arcs of the steel wire segments with circular sections, i.e., cylindrical steel wire segments, to form drainage channels, so that internally cooled type cooling and rapid chip removal are facilitated. An arcuate corner of the grinding surface forms a natural grinding corner, so that the vibration generated when a grinding tool works on a workpiece is reduced, thereby greatly facilitating low-impact grinding. The steel wire segments 1 are shaped by bending. Compared with the process of electroplating the base with diamonds in the prior art, the process of electroplating the steel wire segments with the diamonds can realize mass production simply, which is more conducive to automatic and large-scale production. The steel wire segments with rectangular cross sections, i.e., the sheet-shaped steel wire segments, can be manufactured by a stamping method similar to that of the cylindrical steel wire segments 1. During the manufacturing, the surfaces of the sheet-shaped steel wire segments are plated with the diamonds through an electroplating process to form thin segmented sheets, and the thin segmented sheets are combined to form a grinding wheel with the surface electroplated with single layer of the diamonds, thereby realizing the same effect as that of the cylindrical steel wire segments-combined wheel.

Figure 15:
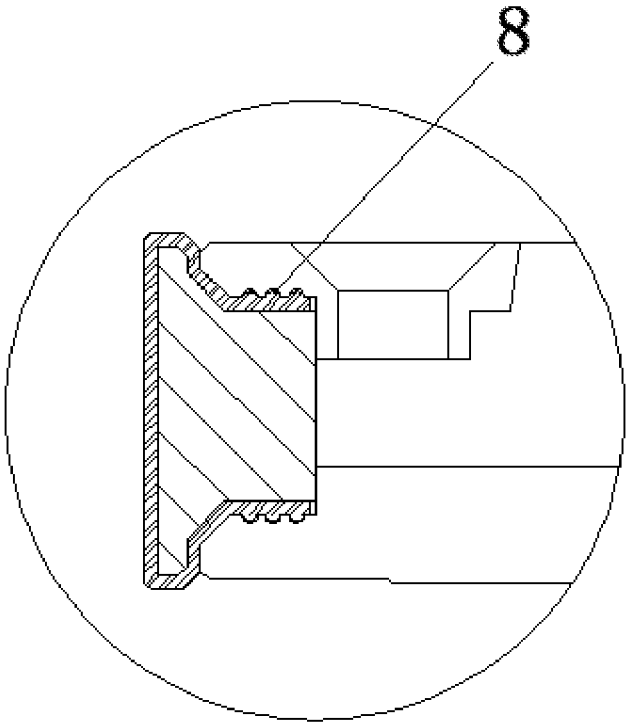
FIG. 15 is a schematic diagram of a U-shaped protruding point according to an embodiment of the present invention.
Figure 16:
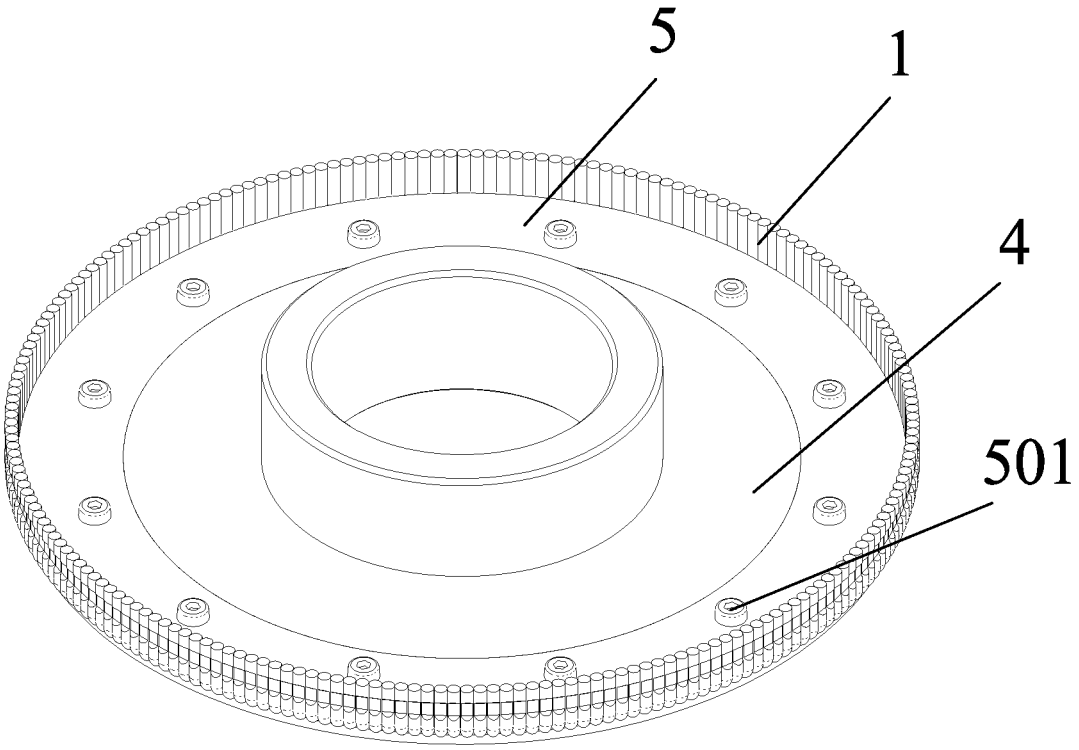
FIG. 16 is an overall schematic structure diagram of a second electroplated steel wire segment-combined grinding wheel according to another embodiment of the present invention.

On the basis of Embodiment 4, Embodiment 7 is as follows. As shown in FIG. 15, a plurality of hemispherical protruding points 8 is disposed on the surface of each of the steel wire segments 1 close to the first annular step 401 and the second annular step 302. The protruding points 8 are disposed in parallel in a radial direction of the first base 4 or the first pressure plate 301. Each of the first annular step 401 and the second annular step 302 is provided with hemispherical grooves corresponding to the protruding points 8 respectively; and the protruding points 8 on the steel wire segments 1 are clamped into the corresponding hemispherical grooves, respectively.

In the above embodiment, as the protruding points 8 are clamped into corresponding wave-shaped clamping grooves in the first base 4 and the first pressure plate 301, the steel wire segments 1 can be stably fixed and are prevented from being deviated.

Figure 1:
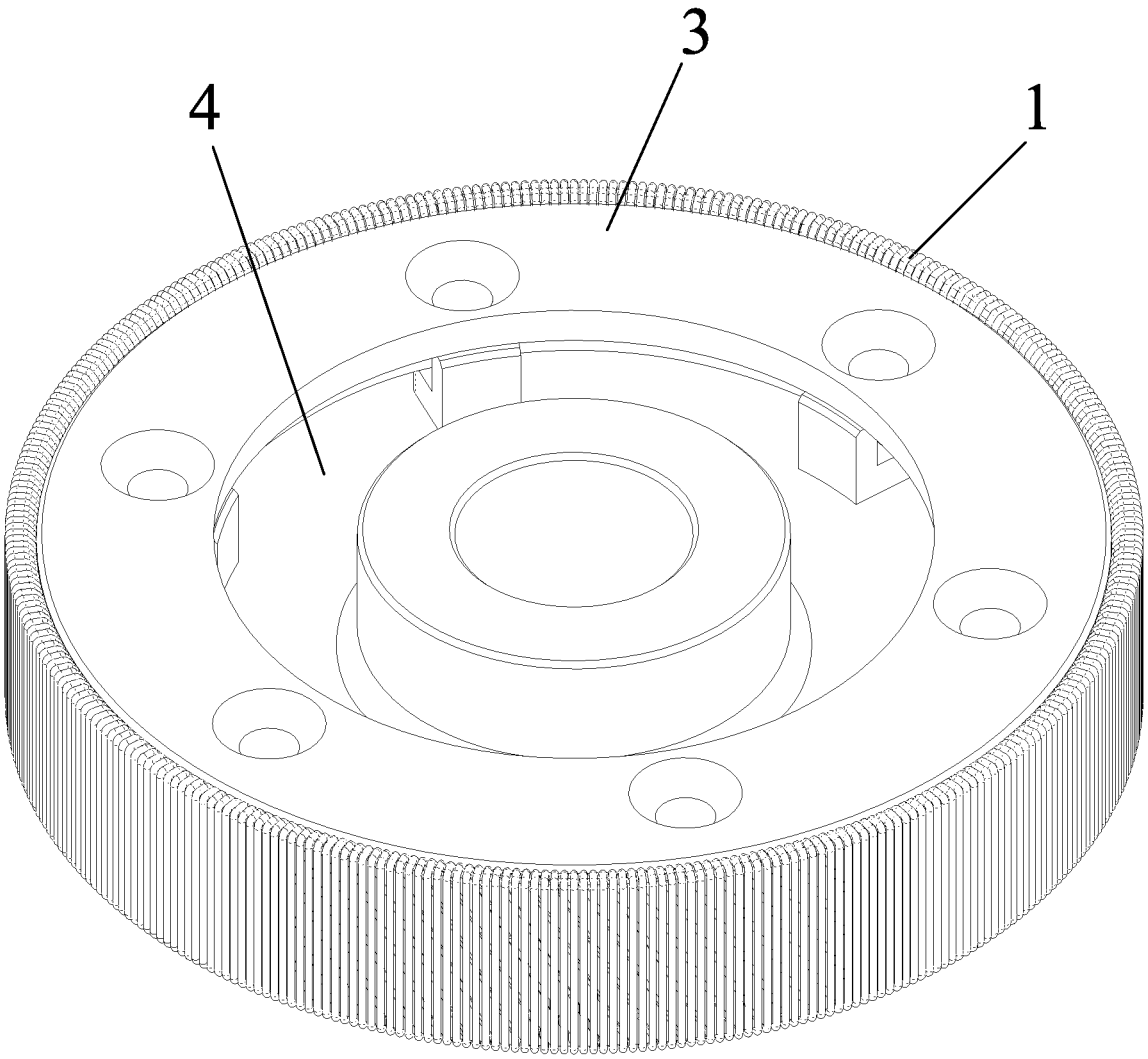
FIG. 1 is a schematic diagram of an overall structure of a first electroplated steel wire segment-combined grinding wheel according to an embodiment of the present invention.

Optionally, as shown in FIG. 1, the steel wire segment 1 at the groove bottom of the first support ring 2 takes the shape of a straight strip.

In the above embodiment, drainage channels are naturally formed between segments and arcs of the steel wire segments 1, so that internally cooled type cooling and rapid chip removal are facilitated.

Figure 11:
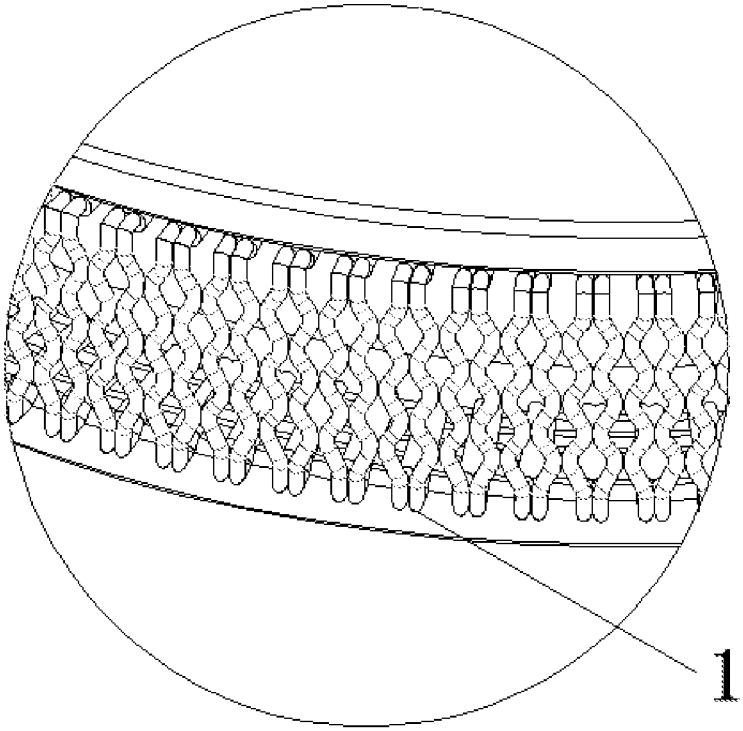
FIG. 11 is an enlarged view of the cylindrical steel wire segments according an embodiment of the present invention.
Figure 14:
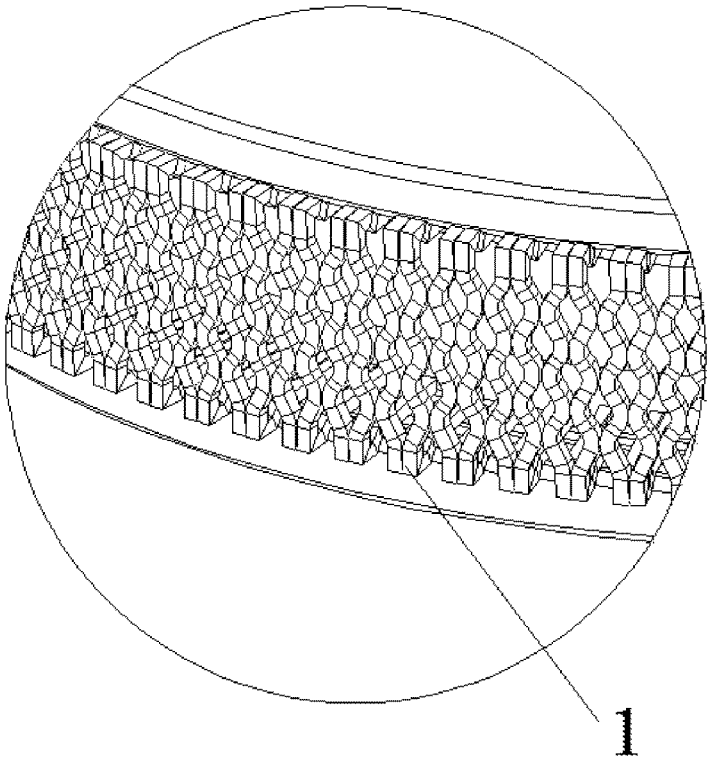
FIG. 14 is an enlarged view of the U-shaped steel wire segments according to an embodiment of the present invention.

On the basis of Embodiment 7, Embodiment 8 is as follows. As shown in FIGS. 9, 11 and 14, the steel wire segment 1 at the groove bottom of the first support ring 2 takes the shape of a straight strip; or the steel wire segment 1 at the groove bottom of the first support ring 2 is circumferentially bent to have a wave shape, and the wave shapes of every two adjacent steel wire segments 1 are opposite to each other to form a plurality of circular through holes axially.

In the above embodiment, the wave-shaped steel wire segments 1 can increase drainage channels, which is more conducive to cooling and rapid chip removal without affecting grinding.

On the basis of Embodiment 2, Embodiment 9 provides a second grinding wheel according to the present invention. As shown in FIGS. 16 to 20, the steel wire segment 1 is bent to have an L shape. The electroplated steel wire segment-combined grinding wheel further includes a pressure disc 5 for pressing the steel wire segments 1, and a plurality of pressure disc screws 501. The pressure disc 5 is of an annular disc structure. A recessed part having the same shape and size as the pressure disc 5 is axially disposed on the outer edge of the first base 4 in a ring; and the pressure disc 5 is embedded in the recessed part. One end of the steel wire segment 1 is parallel to the central axis, and the other end thereof is clamped into a slit between the pressure disc 5 and the first base 4 in the recessed part. The plurality of pressure disc screws 501 is distributed circumferentially at intervals, and successively runs through the pressure disc 5 and the first base 4 to be in threaded connection with screw holes in the first base 4.

In the above embodiment, in the case that the steel wire segments 1 have relatively high rigidity, the steel wire segments are combined and assembled mechanically on the support base without support by the other support components. The base is a reusable tool and can be reused, and it is convenient to replace the working surface combined by the steel wire segments, so that the renovation cost of the grinding wheel is greatly reduced.

On the basis of Embodiment 9, Embodiment 10 is as follows. As shown in FIGS. 21 to 26, the electroplated steel wire segment-combined grinding wheel further includes a support frame for supporting the steel wire segments 1. The support frame is disposed on the pressure disc 5 and includes a plurality of support plates 6, a plurality of support blocks 7 for supporting the support plates 6, and a plurality of support frame screws 601.

The support plate 6 is ring-shaped, the plurality of support plates 6 is axially disposed at intervals, and first clamping grooves 602 for clamping of the steel wire segments 1 are formed in the outer edge of the support plate 6 in a ring. The steel wire segment 1 is clamped into the first clamping groove 602. The support plate 6 close to the pressure disc 5 is supported on the pressure disc 5 through the plurality of support blocks 7, and the plurality of support blocks 7 is supported between adjacent support plates 6. The support blocks 7 in each layer are circumferentially disposed at intervals, and the positions of the support blocks 7 in adjacent layers are the same. The support frame screws 601 correspond to the support blocks 7 on various layers respectively, and successively run through the respective support blocks 7 at the same positions from the topmost support plate 6 to be in threaded connection with screw holes in the pressure disc 5.

In the above embodiment, in the case that the steel wire segments have relatively low rigidity, the steel wire segments 4 are combined and assembled mechanically on the first base used for supporting, and are supported by the support frame, the first base is a reusable tool and can be reused, and it is convenient to replace the working surface combined by the steel wire segments 1, so that the renovation cost of the grinding wheel is greatly reduced.

Figure 17:
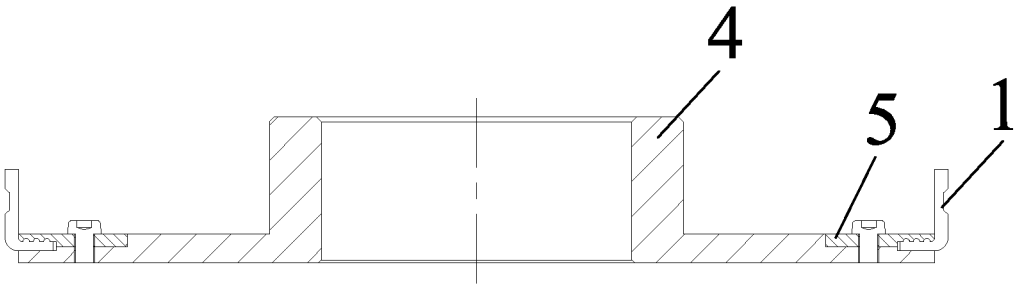
FIG. 17 is a sectional view of FIG. 16 of the present invention.
Figure 18:
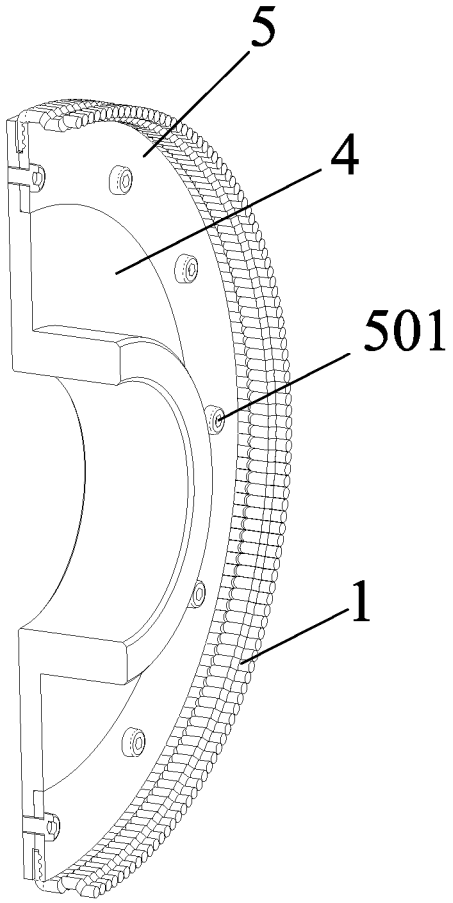
FIG. 18 is another sectional view of FIG. 16 of the present invention.
Figure 19:
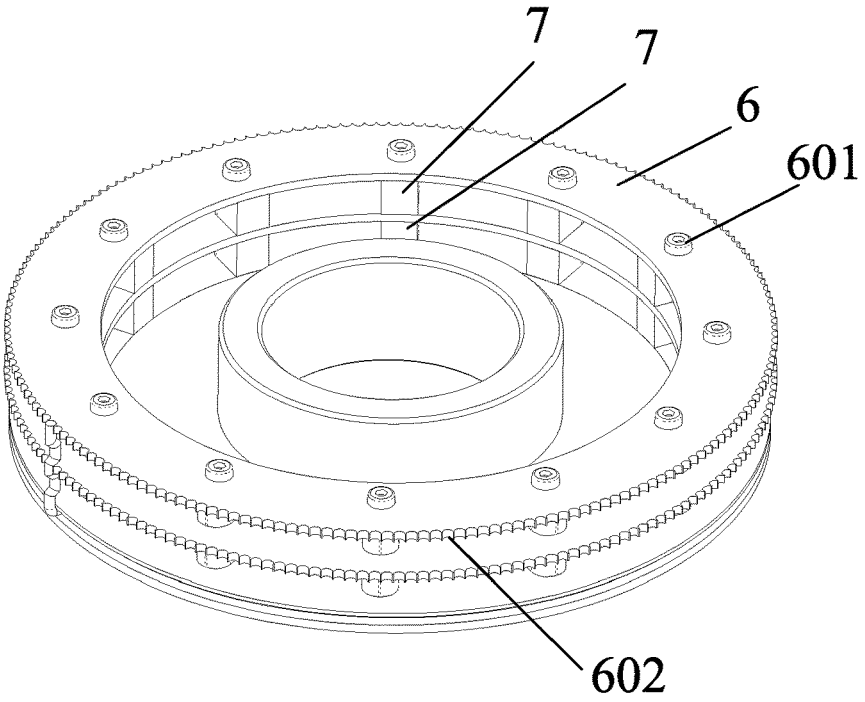
FIG. 19 is a schematic structure diagram of a support frame according to an embodiment of the present invention.
Figure 20:
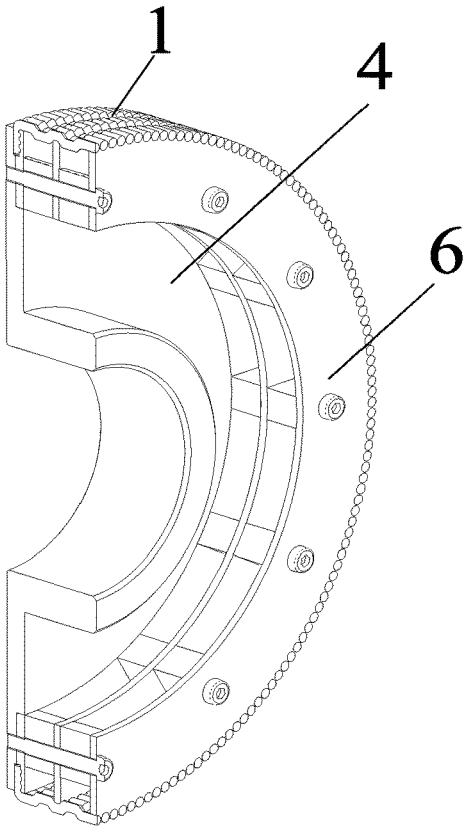
FIG. 20 is a sectional view of the support frame according to the embodiment of the present invention.
Figure 21:
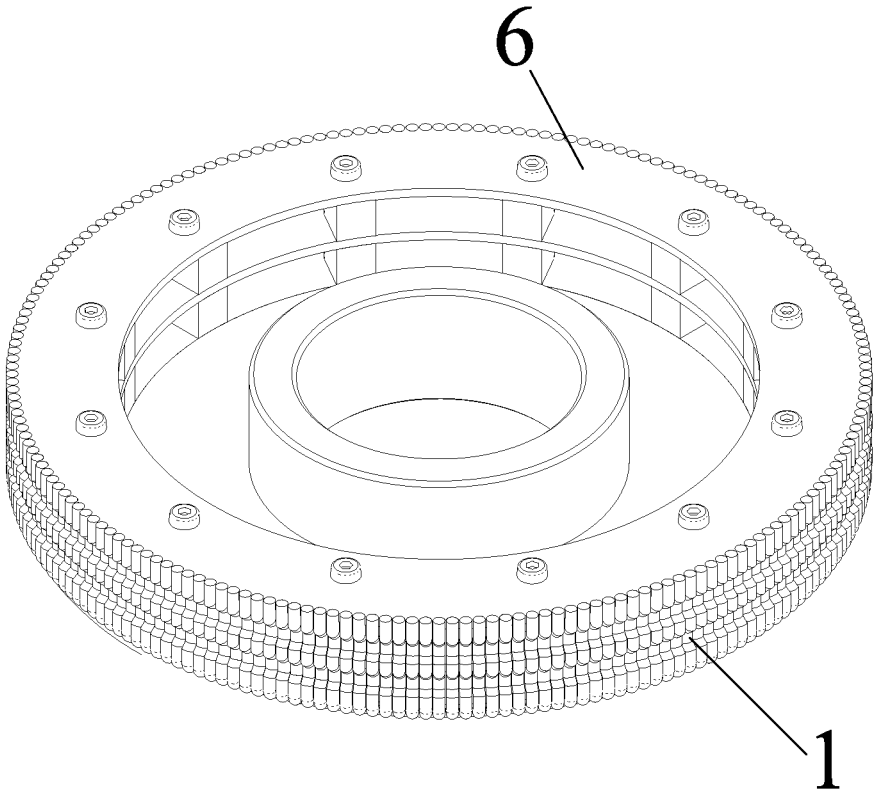
FIG. 21 is a schematic diagram showing connection of steel wire segments and the support frame according to an embodiment of the present invention.
Figure 22:
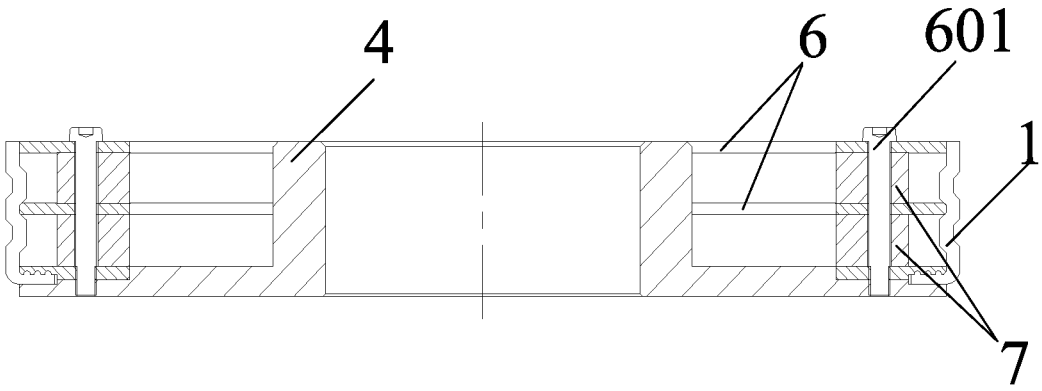
FIG. 22 is a sectional view of FIG. 23 of the present invention.
Figure 23:
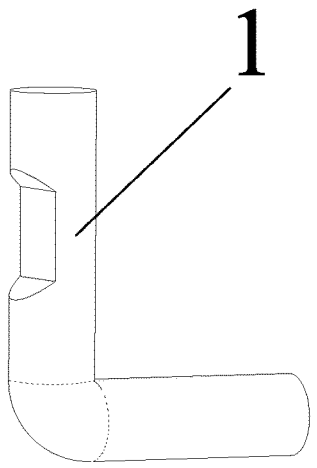
FIG. 23 is a schematic structure diagram of an L-shaped steel wire segment according another embodiment of the present invention.
Figure 24:
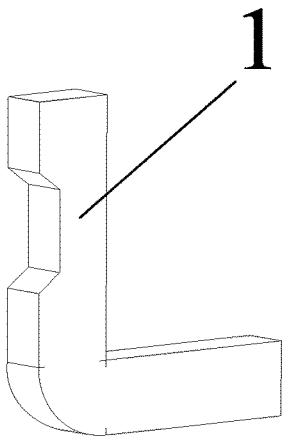
FIG. 24 is a schematic structure diagram of an L-shaped steel wire segment according still another embodiment of the present invention.

Optionally, as shown in FIG. 17, a plurality of hemispherical protruding points 8 is disposed on the surface of each of the steel wire segments 1 close to the first annular step 401 and the second annular step 302. The protruding points 8 are disposed in parallel in a radial direction of the first base 4 or the first pressure plate 301. Each of the first annular step 401 and the second annular step 302 is provided with hemispherical grooves corresponding to the protruding points 8 respectively; and the protruding points 8 on the steel wire segments 1 are clamped into the corresponding hemispherical grooves, respectively.

In the above embodiment, as the protruding points 8 are clamped into corresponding wave-shaped clamping grooves in the first pressure disc 301, the steel wire segments 1 can be stably fixed and are prevented from being deviated.

On the basis of embodiment 10, Embodiment 11 is as follows. One end, parallel to the central axis, of the steel wire segment 1 takes the shape of a straight strip or is axially bent to have a segment shape.

A machining groove for grinding and machining a glass article is formed in the middle of the straight-striped end of the steel wire segment 1.

The machining groove in the steel wire segment 1 is acquired by machining. Specifically, the steel wire segments are assembled in a ring and the assembled wire segments 1 are machined to acquire the machining grooves in a ring.

In the above embodiment, the steel wire segments 1 of different forms can be selected according to machining demands so as to adapt to variety of grinding.

Figure 25:
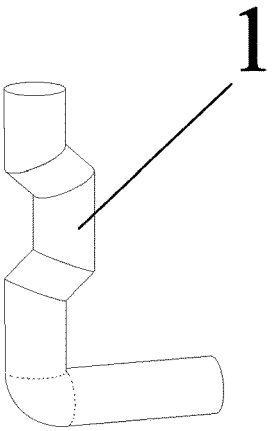
FIG. 25 is a schematic structure diagram of an L-shaped steel wire segment according yet still another embodiment of the present invention.
Figure 26:
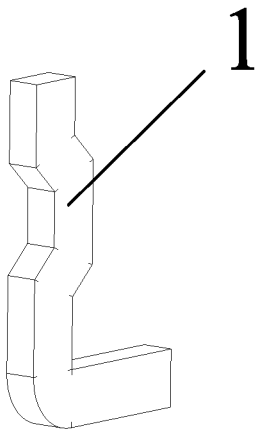
FIG. 26 is a schematic structure diagram of an L-shaped steel wire segment according yet still another embodiment of the present invention.
Figure 27:
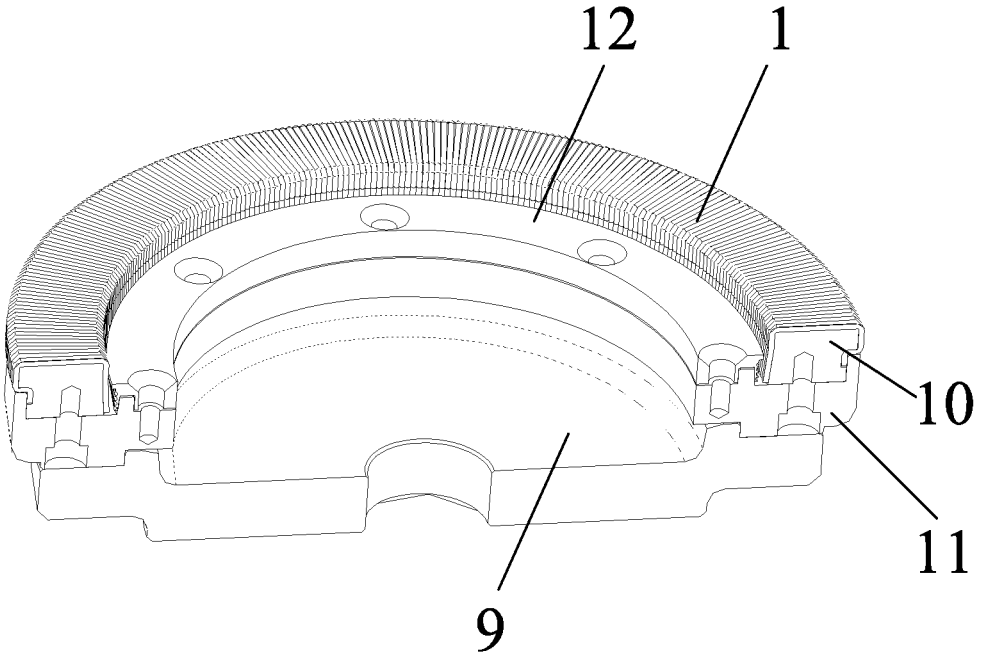
FIG. 27 is a sectional view of a third electroplated steel wire segment-combined grinding wheel according to an embodiment of the present invention.
Figure 28:
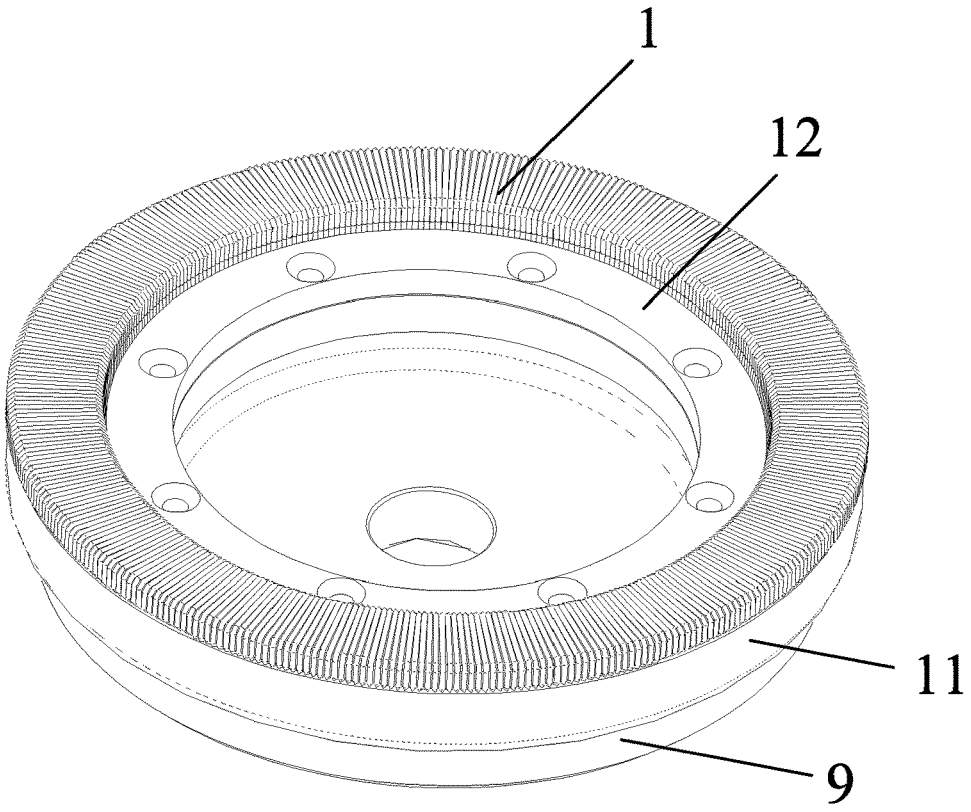
FIG. 28 is an overall schematic structure diagram of the third electroplated steel wire segment-combined grinding wheel according to the embodiment of the present invention.

On the basis of Embodiments 1-11, Embodiment 12 is as follows. As shown in FIGS. 25 and 26, the steel wire segment 1 is formed by bending a steel wire with a circular section, or is formed by bending a steel wire with a rectangular cross section; or the steel wire segment 1 with a rectangular cross section is stamped from a steel plate, that is, the steel wire segment 1 is a sheet-shaped rectangular steel wire segment.

Specifically, the steel wire segment 1 may be stamped from a thin steel plate having a thickness of 0.1-2 mm.

In the above embodiment, arcuate grooves are naturally formed between the segments and segment arcs of the steel wire segments with circular sections, i.e., cylindrical steel wire segments, to form drainage channels, so that internally cooled type cooling and rapid chip removal are facilitated. An arcuate corner of the grinding surface forms a natural grinding corner, so that the vibration generated when a grinding tool works on a workpiece is reduced, thereby greatly facilitating low-impact grinding. The steel wire segments 1 are shaped by bending. Compared with the process of electroplating the base with diamonds in the prior art, the process of electroplating the steel wire segments with the diamonds can realize mass production simply, which is more conducive to automatic and large-scale production. The steel wire segments with rectangular cross sections, i.e., the sheet-shaped steel wire segments, can be manufactured by a stamping method similar to that of the cylindrical steel wire segments 1. During the manufacturing, the surfaces of the sheet-shaped steel wire segments are plated with the diamonds through an electroplating process to form thin segmented sheets, and the thin segmented sheets are combined to form a grinding wheel with the surface electroplated with single layer of diamonds, thereby realizing the same effect as that of the cylindrical steel wire segments-combined wheel.

On the basis of Embodiments 1 to 12, a device mounting hole for connecting the external device may further be formed in the center of the first base 4.

The first grinding wheel and the second grinding wheel according to the present invention have the advantages as follows.

1. The steel wire segments are cylindrical, and the arcuate corner of the grinding surface forms the natural grinding corner, so that the vibration generated when a grinding tool works on a workpiece is reduced, thereby greatly facilitating low-impact grinding.

2. For the steel wire segment-combined grinding wheel, drainage channels are naturally formed between the segments and segment arcs, so that internally cooled type cooling and rapid chip removal are facilitated.

3. The steel wire segments are combined and assembled mechanically on the support base, the base is a reusable tool and can be reused, and it is convenient to replace the working surface combined by the steel wire segments, so that the renovation cost of the grinding wheel is greatly reduced.

4. The steel wire segments are bent to have a required shape. Compared with the process of electroplating the base with diamonds in the prior art, the process of electroplating the steel wire segments with the diamonds can realize mass production simply, which is more conducive to automatic and large-scale production.

5. The sheet-shaped steel wire segments can be manufactured by a stamping method similar to that of the cylindrical steel wire segments 1. During the manufacturing, the surfaces of the sheet-shaped steel wire segments are plated with diamonds through an electroplating process to form thin segmented sheets, and the thin segmented sheets are combined to form a grinding wheel with the surface electroplated with single layer of the diamonds, thereby realizing the same effect as that of the cylindrical steel wire segments-combined wheel.

6. The sheet-shaped steel wire segments are stamped from a steel sheet and thus are more economic.

7. The above technical principles are suitable for peripheral grinding tools, such as grinding wheels of various diameters and small grinding heads.

On the basis of Embodiment 1, Embodiment 13 provides a third grinding wheel according to the present invention. As shown in FIGS. 27 to 40, the base component includes a second base 9. The electroplated steel wire segment-combined grinding wheel further includes a second support ring 10 for supporting the plurality of steel wire segments 1, a third base 11 for fixing the second support ring 10 onto the second base 9, and a holding part 12 for tightly holding the steel wire segments 1. The third base 11 is stacked on one side of the second base 9, and the holding part 12 and the second support ring 10 are disposed on the third base 11 in parallel. The steel wire segments 1 are arranged on the second support ring 10 and are plated with diamonds to form the grinding surface, and one end of the steel wire segment 1 is clamped into a slit between the holding part 12 and the second support ring 10.

It should be understood that after being assembled, the steel wire segments 1 are plated with the diamonds.

In the above embodiment, the steel wire segments are combined and assembled mechanically on the support ring, the base is a reusable tool and can be reused, and it is convenient to replace the grinding surface combined by the steel wire segments 1, so that the renovation cost of the grinding wheel is greatly reduced. For the steel wire segment-combined (cup-shaped) grinding wheel, an axial working surface is formed and drainage channels are naturally formed between the segments and segment arcs, so that internally cooled type cooling and rapid chip removal are facilitated.

On the basis of Embodiment 13, Embodiment 14 is as follows. As shown in FIGS. 29, 30, 31 and 34, the holding part 12 includes a second pressure plate 1201. The second base 9 is of a circular disc structure, and each of the third base 11, the second pressure plate 1201 and the second support ring 10 takes the shape of a ring-shaped disc. The third base 11 is coaxial with the second base 9, and stacked on the outer edge of the third base 11. The second pressure plate 1201 and the second support ring 10 are coaxial with the second base 9 and are disposed on the third base 11 in parallel from inside to outside. The axial length of the second support ring 10 is greater than that of the second pressure plate 1201. The steel wire segments 1 are arranged in a ring, and are bonded onto inner and outer side walls of the second support ring 10 and the side wall, away from the third base 11, of the second support ring 10 in a bent manner.

In the above embodiment, the steel wire segments 1 are combined and assembled mechanically on the second support ring 10 to form an annular grinding surface; one ends of the steel wire segments 1 are tightly held and stably fixed between the second pressure plate 1201 and the holding part 12 to prevent the steel wire segments 1 from becoming loose. The steel wire segments 1 are mounted in a clamping manner, so that it is convenient to replace the all or part of the grinding working surface, and the base is reusable. Thus, the service life of the grinding wheel is prolonged.

Figure 29:
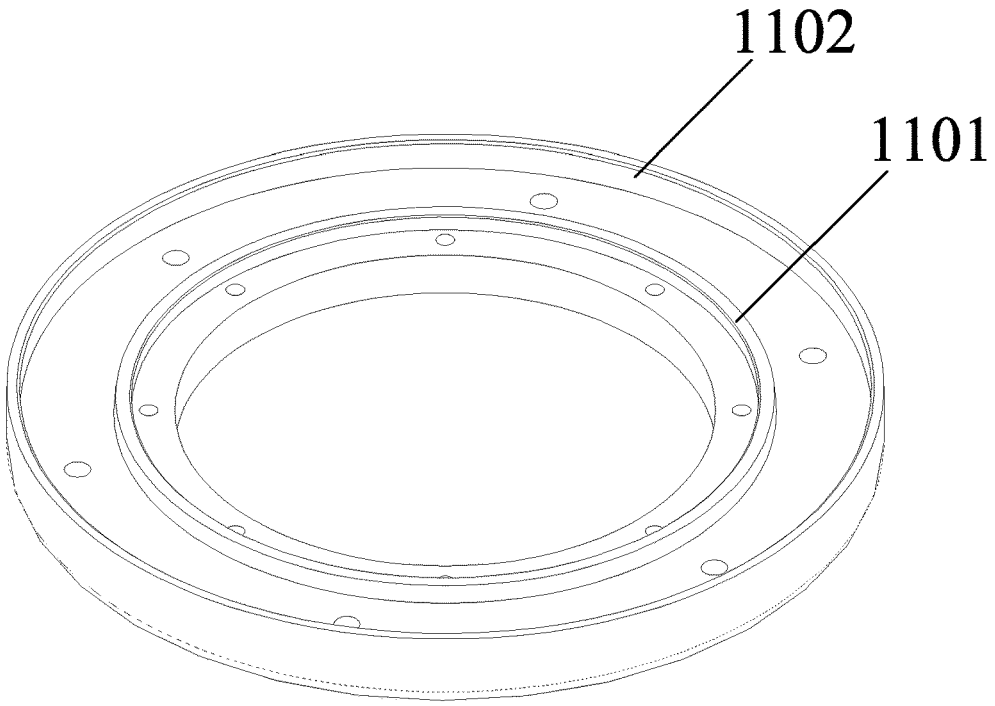
FIG. 29 is a schematic structure diagram of a third base according to an embodiment of the present invention.
Figure 30:
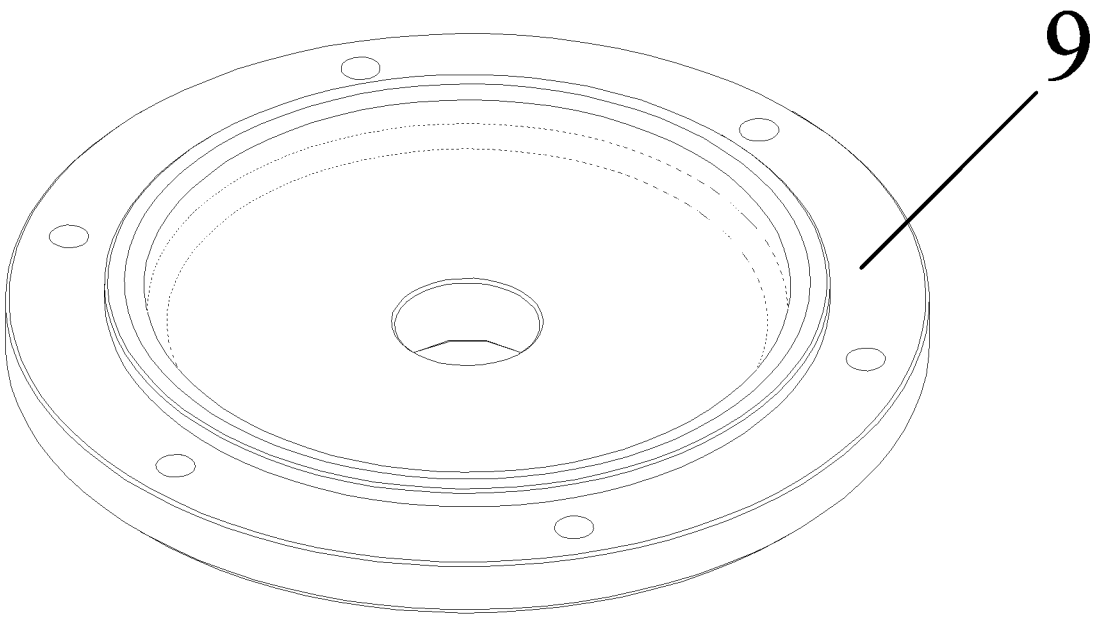
FIG. 30 is a schematic structure diagram of a second base according to an embodiment of the present invention.
Figure 31:
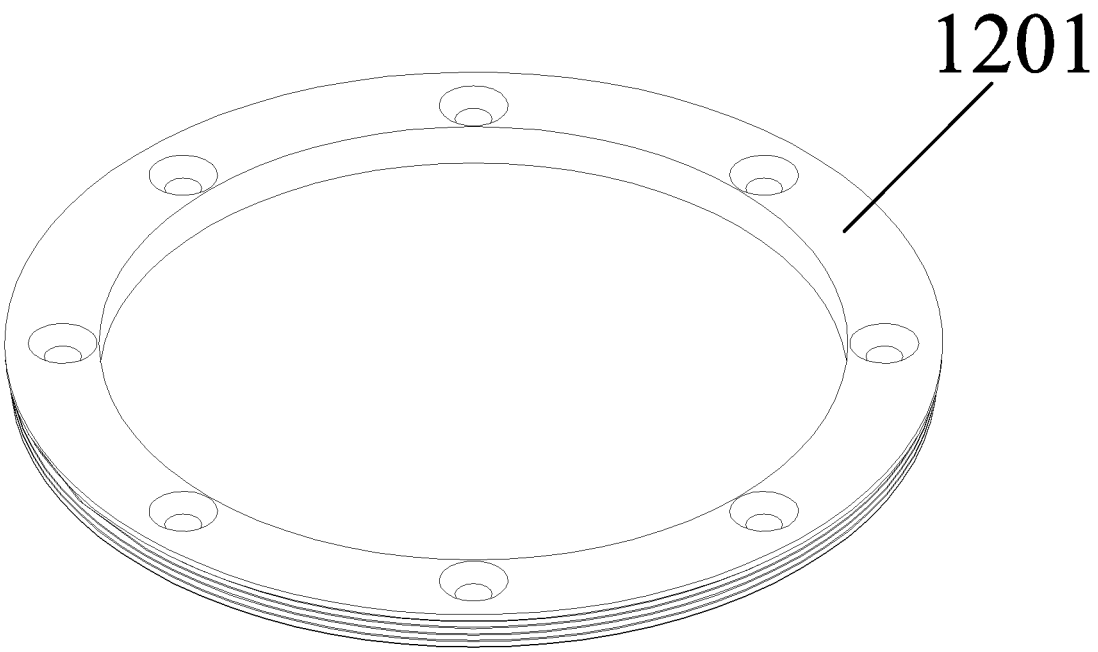
FIG. 31 is a schematic structure diagram of a second pressure plate according to an embodiment of the present invention.

On the basis of Embodiment 14, Embodiment 15 is as follows. As shown in FIG. 29, a first positioning ring 1101 protruding axially is disposed in a ring at the position, corresponding to the second pressure plate 1201, on the third base 11. An annular positioning clamping groove is formed at the position, corresponding to the first positioning ring 1101, on the bottom of the second pressure plate 1201. An opening of the annular positioning clamping groove is disposed downward, and the annular positioning clamping groove is connected with the first positioning ring 1101 in a clamping manner. The second pressure plate 1201 is connected onto the second base 9.

In the above embodiment, the holding part 12 can be rapidly positioned on the second base 9 through the first positioning ring 1101, and the first positioning ring 1101 is stably fixed to prevent displacement during working.

On the basis of Embodiment 14, Embodiment 16 is as follows. A second positioning ring 1102 protruding axially is disposed in a ring at the position, corresponding to the outer edge, on the third base 11. An annular notch is formed in the outer edge of the second support ring 10 in a ring; and the second positioning ring 1102 of the third base 11 is embedded in the annular notch.

Specifically, a plurality of circular holes for mounting of screws is formed in corresponding positions of each of the second base 9 and the third base 11.

As shown in FIG. 29, the second positioning ring 1102 for positioning the third base 11 is also disposed on the second base 9, and is disposed at the inner ring of the second base 9.

In the above embodiment, the holding part 12 can be rapidly positioned on the third base 11 through the second positioning ring 1102, and the second positioning ring 1102 is stably fixed to prevent displacement during working.

Figure 34:
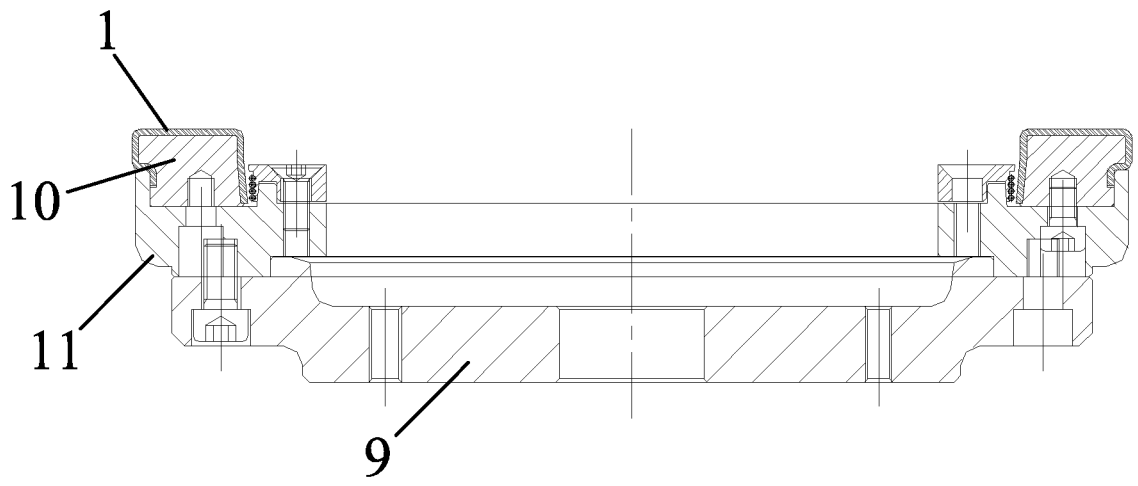
FIG. 34 is a sectional view of the third electroplated steel wire segment-combined grinding wheel according to another embodiment of the present invention.

On the basis of Embodiment 16, Embodiment 17 is as follows. As shown in FIG. 34, the other end of the steel wire segment 1 is clamped into a slit between the annular notch of the second support ring 10 and the second positioning ring 1102 of the third base 11.

In the above embodiment, the two ends of each steel wire segment 1 are clamped to prevent the steel wire segments from being dropped when the base moves rapidly.

Figure 35:
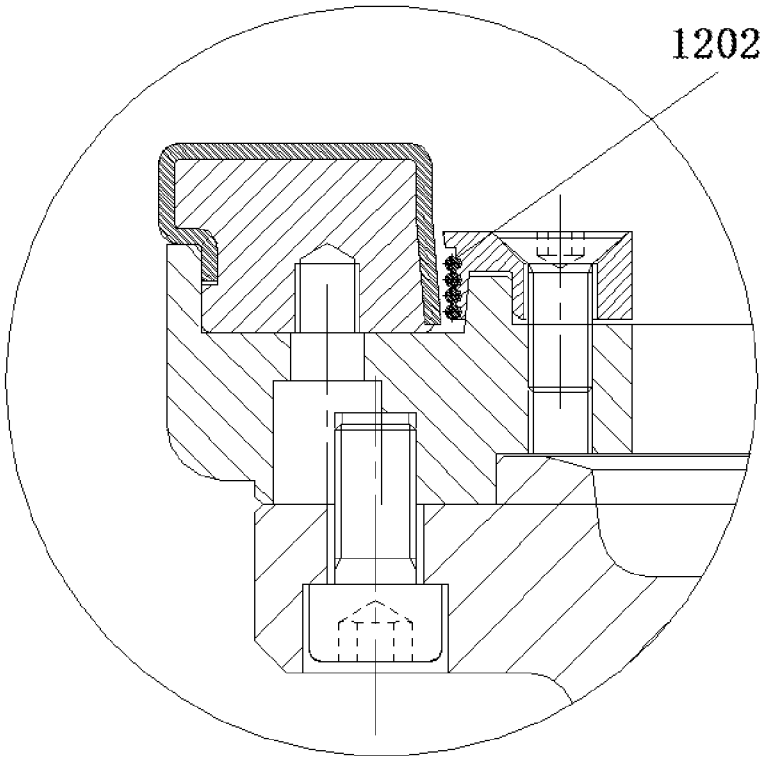
FIG. 35 is a schematic structure diagram of an aluminum wire ring according to an embodiment of the present invention.

On the basis of Embodiment 14, Embodiment 18 is as follows. As shown in FIG. 35, the holding part 12 further includes a plurality of aluminum wire rings 1202 for compressing the steel wire segments 1. The plurality of aluminum wire rings 1202 are axially distributed in parallel and encircle the side wall, close to the steel wire segments 1, of the second pressure plate 1201. The side wall of the second pressure plate 1201 is provided with annular grooves, the number of which corresponds to the number of the plurality of aluminum wire rings 1202. The aluminum wire rings 1202 are embedded in the corresponding annular grooves respectively and abutted against the steel wire segments 1.

In the above embodiment, with the aluminum wire rings 1202, the slits between the holding part 12 and the second support ring 10 are smaller, thereby preventing the steel wire segments 1 from becoming loose.

Figure 36:
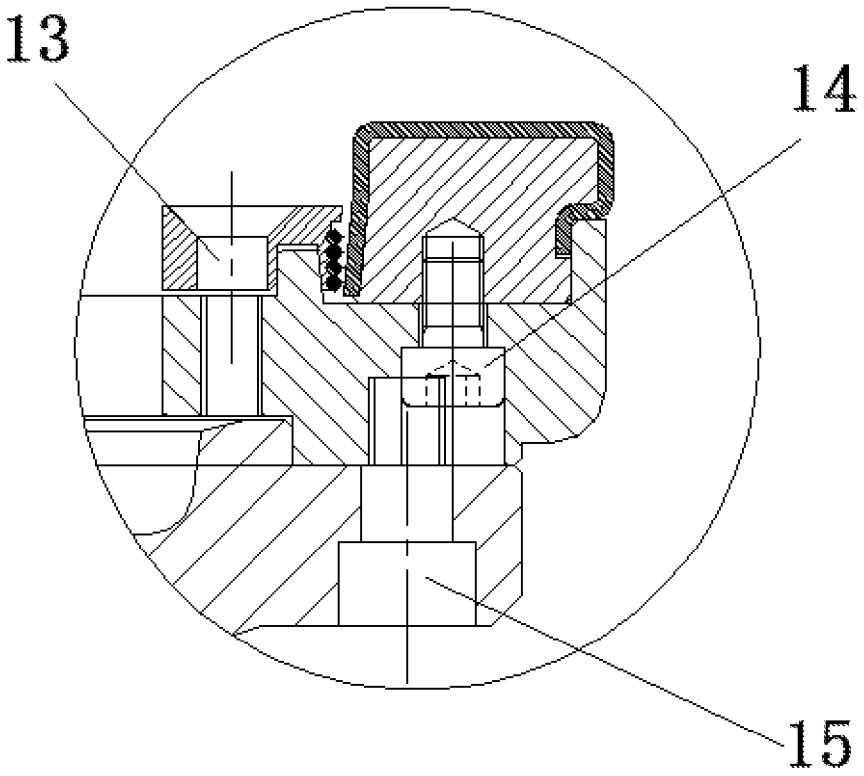
FIG. 36 is a schematic diagram showing mounting of various screws according to an embodiment of the present invention.

On the basis of Embodiment 14, Embodiment 19 is as follows. As shown in FIG. 36, the electroplated steel wire segment-combined grinding wheel further includes a plurality of holding part screws 13, a plurality of support ring screws 14 and a plurality of base screws 15. The holding part screw 13 successively runs through the second pressure plate 1201 and the third base 11 axially to be in threaded connection with a first threaded hole in the third base 11; and the holding part screws 13 are disposed in a ring at equal intervals. The support ring screw 14 successively runs through the third base 11 and the second support ring 10 axially to be in threaded connection with a threaded hole in the second support ring 10; and the support ring screws 14 are disposed in a ring at equal intervals. The plurality of base screws 15 successively run through the second base 9 and the third base 11 axially to be in threaded connection with second threaded holes in the third base 11 respectively, and are disposed in a ring at equal intervals. The plurality of the holding part screws 13 and the plurality of base screws 15 are staggered.

Specifically, the holding part screws 13 are disposed forward, namely, from top to bottom; and the support ring screws 14 and the base screws 15 are disposed reversely, namely, from bottom to top.

In the above embodiment, through the plurality of holding part screws 13, the plurality of support ring screws 14 and the plurality of base screws 15, the second base 9, the third base 11, the holding part 12 and the second support ring 10 can be fixed to one another and are prevented from becoming loose when the whole (cup-shaped) grinding wheel works.

Figure 32:
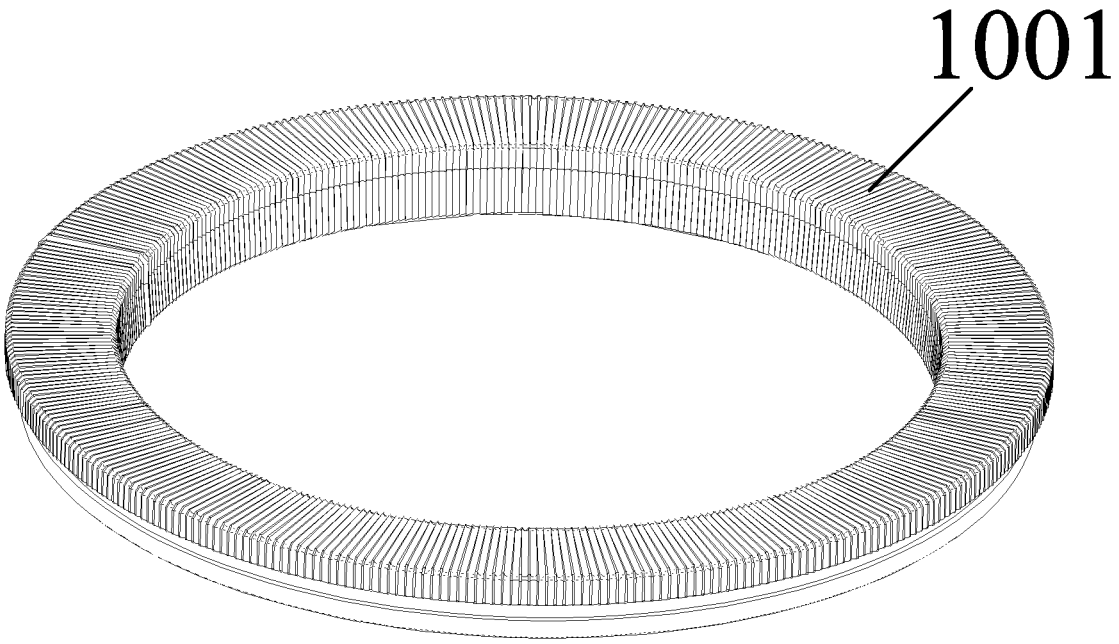
FIG. 32 is a schematic structure diagram of a support ring and a second clamping groove according to an embodiment of the present invention.
Figure 33:
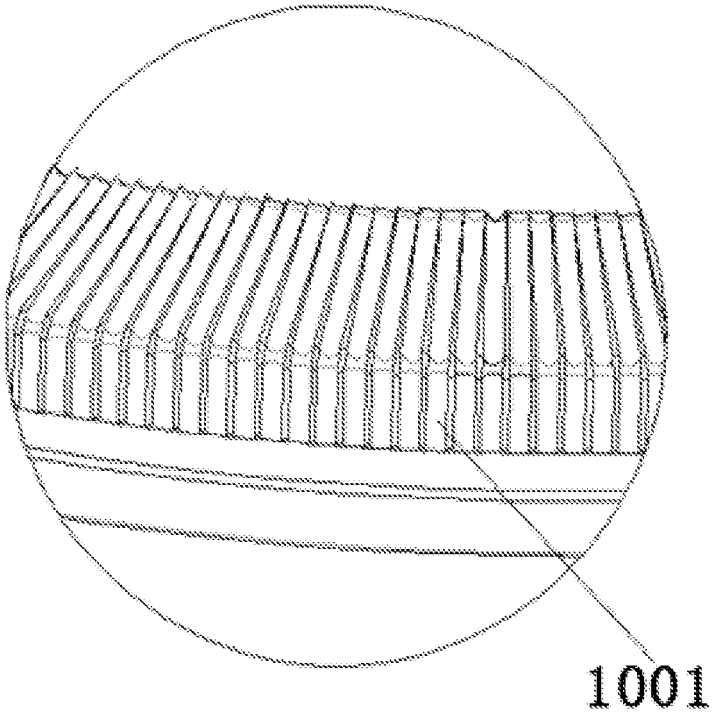
FIG. 33 is an enlarged view of the second clamping groove according to an embodiment of the present invention.
Figure 40:
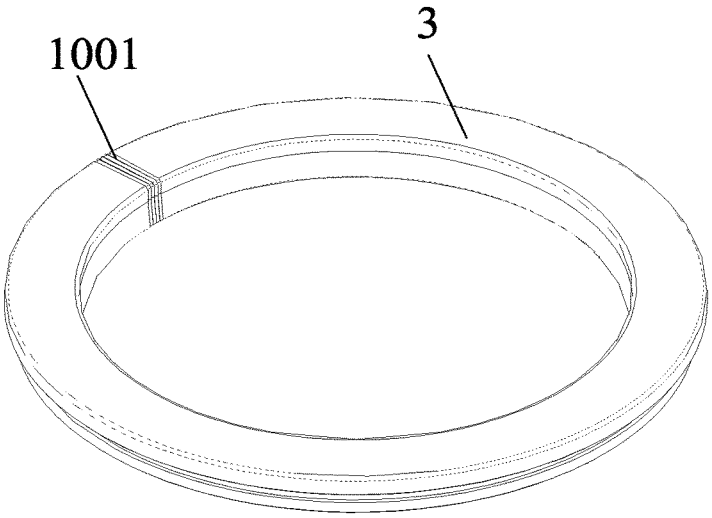
FIG. 40 is a schematic structure diagram of a second support ring according to an embodiment of the present invention.

On the basis of Embodiment 14, Embodiment 20 is as follows. As shown in FIGS. 32, 33 and 40, a plurality of second clamping grooves 1001 for clamping of the steel wire segments 1 is formed in the second support ring 10 in a ring. The second clamping groove 1001 extends from the inner side wall of the second support ring 10 to the outer side wall thereof through the side wall, away from the third base 11, of the second support ring 10. The number of the second clamping grooves 1001 is equal to the number of the steel wire segments 1, and the steel wire segments 1 are correspondingly clamped into the second clamping grooves 1001 respectively.

In the above embodiment, the steel wire segments 1 can be rapidly clamped onto the corresponding positions on the second support ring 10 and are prevented from being displaced.

Figure 37:
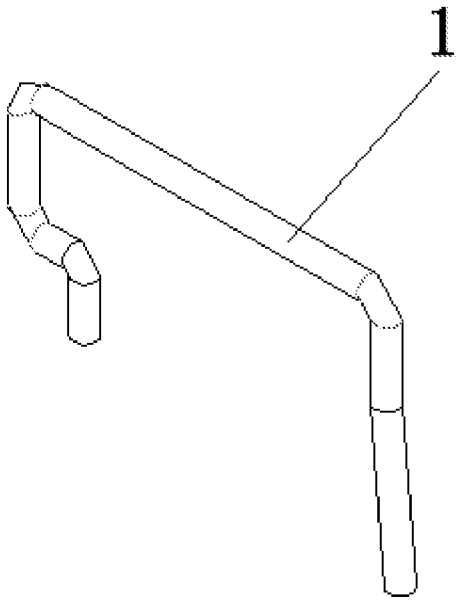
FIG. 37 is a schematic diagram showing mounting of a cylindrical steel wire segment according to an embodiment of the present invention.
Figure 39:
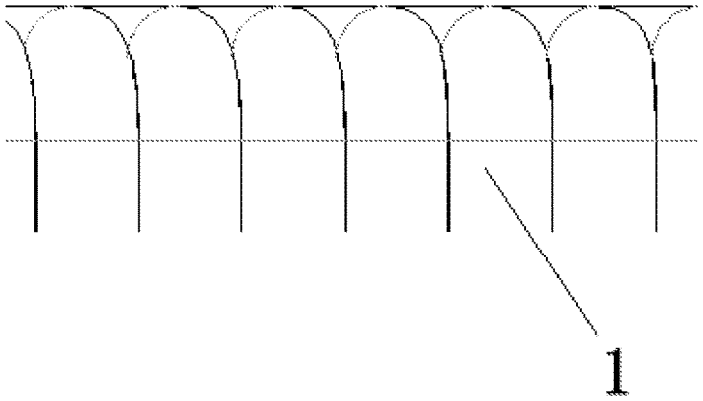
FIG. 39 is a schematic diagram showing arrangement of a plurality of steel wire segments according to an embodiment of the present invention.

On the basis of Embodiments 13-20, Embodiment 21 is as follows. As shown in FIGS. 37 and 39, the steel wire segment 1 is formed by bending a steel wire with a circular section, or is formed by bending a steel wire with a rectangular cross section.

Figure 38:
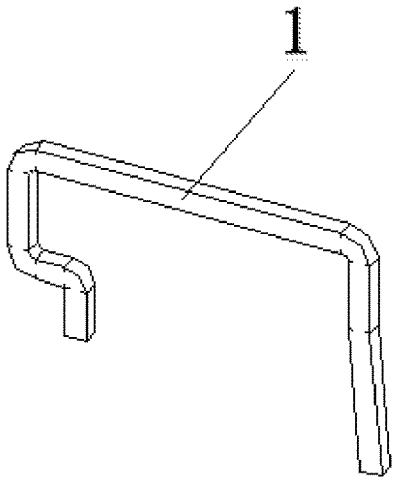
FIG. 38 is a schematic structure diagram of a sheet-like rectangular steel wire segment according an embodiment of the present invention.

On the basis of Embodiment 21, Embodiment 22 is as follows. As shown in FIG. 38, the steel wire segment 1 with a rectangular cross section is stamped from a steel plate, specifically a thin steel plate. That is, the steel wire segment 1 is a sheet-shaped rectangular steel wire segment.

The thickness of the thin steel plate is 0.1-2 mm.

In the above embodiment, drainage channels are naturally formed between the segments and segment arcs of the steel wire segments with circular sections, i.e., cylindrical steel wire segments, so that internally cooled type cooling and rapid chip removal are facilitated. An arcuate corner of the grinding surface forms a natural grinding corner, so that the vibration generated when a grinding tool works on a workpiece is reduced, thereby greatly facilitating low-impact grinding. The steel wire segments are shaped by bending. Compared with the process of electroplating the base with diamonds in the prior art, the process of electroplating the steel wire segments with the diamonds can realize mass production simply, which is more conducive to automatic and large-scale production. The steel wire segments with rectangular cross sections, i.e., the sheet-shaped steel wire segments, can be manufactured by a stamping method similar to that of the cylindrical steel wire segments. During the manufacturing, the surface of a sheet-shaped base is plated with diamonds through an electroplating process to form thin segmented sheets, and the thin segmented sheets are combined to form a grinding wheel with the surface electroplated with single layer of the diamonds, thereby realizing the same effect as that of the cylindrical steel wire segments-combined wheel.

The third grinding wheel according to the present invention has the advantages as follows.

1. The steel wire segments are cylindrical, and the arcuate corner of the grinding surface forms the natural grinding corner, so that the vibration generated when a grinding tool works on a workpiece is reduced, thereby greatly facilitating low-impact grinding.

2. For the steel wire segment-combined grinding wheel, arcuate grooves are naturally formed between the segments and segment arcs to form a large number of dense drainage channels, so that internally cooled type cooling and rapid chip removal are facilitated.

3. The steel wire segments are combined and assembled mechanically on the support base, the base is a reusable tool and can be reused, and it is convenient to replace the working surface combined by the steel wire segments, so that the renovation cost of the grinding wheel is greatly reduced.

4. The steel wire segments are bent to have a required shape. Compared with the process of electroplating the base with diamonds in the prior art, the process of electroplating the steel wire segments with the diamonds can realize mass production simply, which is more conducive to automatic and large-scale production.

5. The sheet-shaped steel wire segments can be manufactured by a stamping method similar to that of the cylindrical steel wire segments. During the manufacturing, the surfaces of the sheet-shaped steel wire segments are plated with diamonds through an electroplating process to form thin segmented sheets, and the thin segmented sheets are combined to form a grinding wheel with the surface electroplated with single layer of the diamonds, thereby realizing the same effect as that of the cylindrical steel wire segments-combined wheel.

6. The sheet-shaped rectangular steel wire segments can be made from the thin steel plate by a stamping method similar to that of the cylindrical steel wire segments. During the manufacturing, the surfaces of the sheet-shaped steel wire segments are plated with diamonds through an electroplating process to form thin segmented sheets, and the thin segmented sheets are combined to form a grinding wheel with the surface electroplated with single layer of the diamonds, thereby realizing the same effect as that of the cylindrical steel wire segments-combined wheel.

The above description is only preferred embodiments of the present invention, and is not intended to limit the present invention. Any modifications, equivalent replacements, improvements and the like made within the spirit and principles of the present invention should be included within the scope of protection of the present invention.

What is claimed is:

1. An electroplated steel wire segment-combined grinding wheel, comprising:

a base component for connecting an external device, and a plurality of steel wire segments, wherein the plurality of steel wire segments are combined and assembled on the base component in a ring, and outer walls of the plurality of steel wire segments are plated with diamonds to form a grinding surface, further comprising a first support ring for supporting the plurality of steel wire segments, and a fixing part for fixing the first support ring, wherein the base component comprises a first base;

the fixing part is disposed opposite to the first base, and the first support ring is held between the fixing part and the first base;

the plurality of steel wire segments are arranged on an outer wall of the first support ring;

the first base is of a circular disc structure, the fixing part comprises a first pressure plate of an annular disc structure, and the first support ring has an annular groove structure;

the first pressure plate is disposed coaxially opposite to the first base;

a groove bottom of the first support ring is disposed outward and parallel to a central axis of the first base, a groove opening of the first support ring is disposed inward, a first end of the groove opening of the first support ring is abutted against an outer edge of the first base, and a second end of the groove opening of the first support ring is abutted against an outer edge of the first pressure plate;

a cavity is formed among the first base, the first support ring and the first pressure plate;

each of the plurality of steel wire segments is bent to have a U shape and bonded to an outer wall of the groove bottom of the first support ring, a first end of each of the plurality of steel wire segments is clamped into a slit between the first base and the first end of the groove opening of the first support ring, a second end of each of the plurality of steel wire segments is clamped into a slit between the first pressure plate and the second end of the groove opening of the first support ring, and the plurality of steel wire segments are arranged circumferentially in parallel;

the first base is recessed axially in the ring in proximity to an end face of the first pressure plate and at the outer edge of the first pressure plate to form a first annular step;

the first pressure plate is protruded axially in the ring in proximity to both an end face and an inner edge of the first base to form an annular protrusion, and a second annular step is formed in proximity to the outer edge of the first pressure plate;

the first end and the second end of the groove opening of the first support ring are abutted against the first annular step and the second annular step respectively, a first end of an outer side of the groove bottom of the first support ring extends out of the outer edge of the first pressure plate, and a second end of the outer side of the groove bottom of the first support ring extends out of the outer edge of the first base;

a plurality of hemispherical protruding points is disposed on a surface of each of the plurality of steel wire segments in contact with the first annular step and the second annular step;

the plurality of hemispherical protruding points are disposed in parallel in a radial direction of the first base or the first pressure plate;

each of the first annular step and the second annular step is provided with hemispherical grooves corresponding to the plurality of hemispherical protruding points respectively; and the plurality of hemispherical protruding points on the plurality of steel wire segments are clamped into corresponding hemispherical grooves, respectively.

2. The electroplated steel wire segment-combined grinding wheel according to claim 1, wherein the first support ring is provided with a plurality of water groove outlets in the ring for leaking a cooling water, wherein the plurality of water groove outlets extend from an edge of the first end of the groove opening of the first support ring to an edge of the second end of the groove opening of the first support ring along a direction towards the groove bottom of the first support ring, and the plurality of water groove outlets are arranged at equal intervals;

an opening of each of the plurality of water groove outlets at the edge of the first end of the groove opening of the first support ring and the edge of the second end of the groove opening of the first support ring extends obliquely along a rotation direction of the first base; and for an opening of each of the plurality of water groove outlets at the groove bottom of the first support ring, by taking a middle as a reference, a first end of the opening in proximity to the fixing part extends obliquely along the rotation direction of the first base, and a second end of the opening in proximity to the first base extends obliquely along a direction opposite to the rotation direction.

3. The electroplated steel wire segment-combined grinding wheel according to claim 1, wherein the fixing part further comprises a plurality of mounting blocks and a plurality of fixing screws, wherein the plurality of mounting blocks are disposed on an end face, in contact with the first pressure plate, of the first base in the ring at equal intervals, each of the plurality of mounting blocks is of an L-shaped structure, a first end of the each of the plurality of mounting blocks is parallel to the end face of the first base, bonded to the first base, abutted against an annular protrusion of the first pressure plate, and provided with a threaded hole, and a second end of the each of the plurality of mounting blocks is perpendicular to the first base and abutted against an inner edge of the first pressure plate;

the first pressure plate is provided with mounting holes, wherein a number of the mounting holes is equal to a number of the plurality of mounting blocks, and the mounting holes are in one-to-one correspondence with the plurality of mounting blocks; and a number of the plurality of fixing screws is equal to the number of the plurality of mounting blocks, and the plurality of fixing screws are in one-to-one correspondence with the mounting holes and the plurality of fixing screws run through the annular protrusion from the mounting holes to be in connected with threaded holes in the each of the plurality of mounting blocks, respectively.

4. The electroplated steel wire segment-combined grinding wheel according to claim 1, wherein each of the plurality of steel wire segments at the groove bottom of the first support ring takes a shape of a straight strip;

or each of the plurality of steel wire segments at the groove bottom of the first support ring is circumferentially bent to have a wave shape, and wave shapes of every two adjacent steel wire segments are opposite to each other to form a plurality of circular through holes axially.

5. The electroplated steel wire segment-combined grinding wheel according to claim 1, wherein each of the plurality of steel wire segments is bent to have an L shape;

the electroplated steel wire segment-combined grinding wheel further comprising:

a pressure disc for pressing the plurality of steel wire segments, and a plurality of pressure disc screws, the pressure disc is of an annular disc structure;

a recessed part having an identical shape and size as the pressure disc is axially disposed on an outer edge of the first base in the ring;

the pressure disc is embedded in the recessed part, a first end of each of the plurality of steel wire segments is parallel to a central axis, and a second end of each of the plurality of steel wire segments is clamped into a slit between the pressure disc and the first base in the recessed part; and the plurality of pressure disc screws are distributed circumferentially at intervals, and successively run through the pressure disc and the first base to be in threaded connection with screw holes in the first base.

6. The electroplated steel wire segment-combined grinding wheel according to claim 5, further comprising a support frame for supporting the plurality of steel wire segments, wherein the support frame is disposed on the pressure disc, and the support frame comprises a plurality of support plates, a plurality of support blocks for supporting the plurality of support plates, and a plurality of support frame screws;

each of the plurality of support plates is ring-shaped, the plurality of support plates are axially disposed at intervals, and first clamping grooves for clamping of the plurality of steel wire segments are formed in an outer edge of each of the plurality of support plate in the ring;

each of the plurality of steel wire segments is clamped into each of the first clamping grooves;

each of the plurality of support plates close to the pressure disc is supported on the pressure disc through the plurality of support blocks, and the plurality of support blocks are supported between adjacent support plates;

the plurality of support blocks in each layer are circumferentially disposed at intervals, and positions of the plurality of support blocks in adjacent layers are identical; and the plurality of support frame screws correspond to the plurality of support blocks at various layers respectively, and successively run through respective support blocks at identical positions from a topmost support plate to be in threaded connection with screw holes in the pressure disc.

7. The electroplated steel wire segment-combined grinding wheel according to claim 6, wherein the first end, parallel to the central axis, of each of the plurality of steel wire segments takes a shape of a straight strip, or is axially bent to have a segment shape.

8. The electroplated steel wire segment-combined grinding wheel according to claim 1, wherein each of the plurality of steel wire segments is formed by bending a steel wire with a circular section, or each of the plurality of steel wire segments is formed by bending the steel wire with a rectangular cross section.

9. The electroplated steel wire segment-combined grinding wheel according to claim 1, wherein the base component comprises a second base;

the electroplated steel wire segment-combined grinding wheel further comprising: a second support ring for supporting the plurality of steel wire segments, a third base for fixing the second support ring onto the second base, and a holding part for holding the plurality of steel wire segments;

the third base is stacked on a side of the second base, and the holding part and the second support ring are disposed on the third base in parallel; and the plurality of steel wire segments are arranged on the second support ring and are plated with the diamonds to form the grinding surface, and a first end of each of the plurality of steel wire segments is clamped into a slit between the holding part and the second support ring.

10. The electroplated steel wire segment-combined grinding wheel according to claim 9, wherein the holding part comprises a second pressure plate, the second base is of a circular disc structure, and each of the third base, the second pressure plate and the second support ring takes a shape of a ring-shaped disc;

the third base is coaxial with the second base, and stacked on an outer edge of the second base;

the second pressure plate and the second support ring are coaxial with the second base and are disposed on the third base in parallel from inside to outside, and an axial length of the second support ring is greater than an axial length of the second pressure plate; and the plurality of steel wire segments are arranged in the ring, and are bonded onto inner and outer side walls of the second support ring and a side wall, away from the third base, of the second support ring in a bent manner.

11. The electroplated steel wire segment-combined grinding wheel according to claim 10, wherein a first positioning ring protruding axially is disposed in the ring at a position, corresponding to the second pressure plate, on the third base;

an annular positioning clamping groove is formed at a position, corresponding to the first positioning ring, on a bottom of the second pressure plate;

an opening of the annular positioning clamping groove is disposed downward, and the annular positioning clamping groove is connected with the first positioning ring in a clamping manner; and the second pressure plate is connected onto the second base.

12. The electroplated steel wire segment-combined grinding wheel according to claim 11, wherein a second positioning ring protruding axially is disposed in the ring at a position, corresponding to the outer edge, on the third base;

an annular notch is formed in an outer edge of the second support ring in the ring; and the second positioning ring of the third base is embedded in the annular notch.

13. The electroplated steel wire segment-combined grinding wheel according to claim 12, wherein a second end of each of the plurality of steel wire segments is clamped into a slit between the annular notch of the second support ring and the second positioning ring of the third base.

14. The electroplated steel wire segment-combined grinding wheel according to claim 10, wherein the holding part further comprises a plurality of aluminum wire rings for compressing the plurality of steel wire segments, wherein the plurality of aluminum wire rings are axially distributed in parallel and encircle a side wall, close to the plurality of steel wire segments, of the second pressure plate, the side wall of the second pressure plate is provided with annular grooves, a number of the annular grooves corresponds to a number of the plurality of aluminum wire rings, and the plurality of aluminum wire rings are embedded in corresponding annular grooves respectively and abutted against the plurality of steel wire segments.

15. The electroplated steel wire segment-combined grinding wheel according to claim 10, further comprising a plurality of holding part screws, a plurality of support ring screws and a plurality of base screws, wherein each of the plurality of holding part screws successively runs through the second pressure plate and the third base axially to be in threaded connection with a first threaded hole in the third base, and the plurality of holding part screws are disposed in the ring at equal intervals;

each of the plurality of support ring screws successively runs through the third base and the second support ring axially to be in threaded connection with a threaded hole in the second support ring, and the plurality of support ring screws are disposed in the ring at equal intervals;

the plurality of base screws successively run through the second base and the third base axially to be in threaded connection with second threaded holes in the third base respectively, and are disposed in a ring at equal intervals; and the plurality of holding part screws and the plurality of base screws are staggered.

16. The electroplated steel wire segment-combined grinding wheel according to claim 10, wherein a plurality of second clamping grooves for clamping of the plurality of steel wire segments is formed in the second support ring in the ring, wherein each of the plurality of second clamping groove extends from an inner side wall of the second support ring to an outer side wall of the second support ring through a side wall, away from the third base, of the second support ring, a number of the plurality of second clamping grooves is equal to a number of the plurality of steel wire segments, and the plurality of steel wire segments (1) are correspondingly clamped into the plurality of second clamping grooves.

17. The electroplated steel wire segment-combined grinding wheel according to claim 16, wherein each of the plurality of steel wire segments is formed by bending a steel wire with a circular section, or each of the plurality of steel wire segments is formed by bending a steel wire with a rectangular cross section.

18. The electroplated steel wire segment-combined grinding wheel according to claim 17, wherein each of the plurality of steel wire segments with the rectangular cross section is stamped from a steel plate.

* * * * *